US006748357B1

(12) United States Patent
Saruhashi

(10) Patent No.: US 6,748,357 B1
(45) Date of Patent: Jun. 8, 2004

(54) DEVICE AND METHOD FOR REPRODUCTION OF SOUNDS WITH INDEPENDENTLY VARIABLE DURATION AND PITCH

(75) Inventor: Takashi Saruhashi, Osaka (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/008,946

(22) Filed: Jan. 20, 1998

(30) Foreign Application Priority Data

Jan. 20, 1997 (JP) ..... 9-007654
Oct. 31, 1997 (JP) ..... 9-300403

(51) Int. Cl.[7] ..... G10L 13/00
(52) U.S. Cl. ..... 704/258; 704/270
(58) Field of Search ..... 704/270, 278, 704/267, 704, 258

(56) References Cited

U.S. PATENT DOCUMENTS 3,946,504 A * 3/1976 Nakano ..... 35/35
4,805,217 A * 2/1989 Morihiro et al. ..... 381/35
4,876,937 A 10/1989 Suzuki ..... 52/287.1
5,231,671 A 7/1993 Gibson et al.
5,301,259 A 4/1994 Gibson et al.
5,315,057 A * 5/1994 Land et al. ..... 84/601
5,347,478 A * 9/1994 Suzuki et al. ..... 364/715.02
5,412,152 A 5/1995 Kageyama et al. ..... 84/607
5,428,708 A 6/1995 Gibson et al.
5,471,009 A * 11/1995 Oba et al. ..... 84/645
5,499,316 A * 3/1996 Sudoh et al. ..... 395/2.79
5,511,000 A * 4/1996 Kaloi et al. ..... 364/514
5,611,018 A * 3/1997 Tanaka et al. ..... 395/2.24
5,641,926 A 6/1997 Gibson et al.
5,675,709 A * 10/1997 Chiba ..... 395/2.87
5,713,021 A * 1/1998 Kondo et al. ..... 395/614
5,717,818 A * 2/1998 Nejime et al. ..... 395/2.2
5,734,119 A * 3/1998 France et al. ..... 84/622
5,745,650 A * 4/1998 Otsuka et al. ..... 395/269
5,763,800 A * 6/1998 Rossum et al. ..... 84/603
5,765,129 A * 6/1998 Hyman et al. ..... 704/270
5,774,863 A * 6/1998 Okano et al. ..... 704/278
5,781,696 A * 7/1998 Oh et al. ..... 395/2.79
5,792,971 A 8/1998 Timis et al. ..... 84/609
5,809,454 A * 9/1998 Okada et al. ..... 704/214
5,847,303 A * 12/1998 Matsumoto ..... 84/610
5,873,059 A * 2/1999 Iijima et al. ..... 704/207
5,886,278 A 3/1999 Yoshida ..... 84/604
5,986,198 A 11/1999 Gibson et al.
6,046,395 A 4/2000 Gibson et al.
6,087,578 A 7/2000 Kay
6,103,964 A 8/2000 Kay
6,121,532 A 9/2000 Kay
6,121,533 A 9/2000 Kay
6,169,240 B1 1/2001 Suzuki ..... 84/605

OTHER PUBLICATIONS

"Understanding MIDI", Doan, IEEE Potentials, Feb. 1994.*
Keith Lent, *An Efficient Method for Pitch Shifting Digitally Sampled Sounds*, Computer Music Journal, vol. 13, No. 4 Winter 1989, pp 65–71.

* cited by examiner

*Primary Examiner*—Doris H. To
*Assistant Examiner*—Michael N. Opsasnick
(74) *Attorney, Agent, or Firm*—Foley & Lardner

(57) ABSTRACT

The waveform generation device can reproduce waveform data of various sounds stored in a memory at a reproduction velocity of reproducing waveforms at a real time and is provided with a storage system for storing the waveform data of a waveform sequence with the plural waveforms arrange in time series, a pitch information input system for entering pitch information, a time information generating system for generating time information changing at a velocity having no connection with the pitch to be reproduced, and a reproduction means for reproducing the waveform data to be read at the reproduction pitch waveform data of the pitch information input system, including a reading system for reading the waveform data from the storage system at a desired reading velocity corresponding to the time information and the pitch information yet having no connection with the velocity of changing the time information.

14 Claims, 29 Drawing Sheets

FIG.2

<PARAMETER 1 STORAGE UNIT : STATUS REGION>

| | ADDRESS | : DATA |
|---|---|---|
| BANK 0 | 0000 – 000F | :WAVEFORM NAME wn |
| | 0010 | :SAMPLING FREQUENCY sr |
| | 0011 | :ORIGINAL PITCH op |
| | 0012 | :PITCH SHIFT VOLUME opsv FROM ORIGINAL KEY |
| | 0013 | :OUTPUT LEVEL ol |
| | | : : |
| BANK 1 | 0020 – 002F | :WAVEFORM NAME wn |
| | 0030 | :SAMPLING FREQUENCY sr |
| | 0031 | :ORIGINAL PITCH op |
| | 0032 | :PITCH SHIFT VOLUME opsv FROM ORIGINAL KEY |
| | 0033 | :OUTPUT LEVEL ol |
| | | : : |
| BANK 2 | 0040 – 004F | :WAVEFORM NAME wn |
| | 0058 | :SAMPLING FREQUENCY sr |
| | 0059 | :ORIGINAL PITCH op |
| | 005A | :PITCH SHIFT VOLUME opsv FROM ORIGINAL KEY |
| | 005B | :OUTPUT LEVEL ol |
| | | : : |

FIG.3

<PARAMETER 2 STORAGE UNIT : SYLLABLE MARK REGION>

| | ADDRESS | : DATA |
|---|---|---|
| BANK 0 | 00000 | :SYLLABLE 1 MARK sm1 |
| | 00001 | :SYLLABLE 2 MARK sm2 |
| | 00002 | :SYLLABLE 3 MARK sm3 |
| | 00003 | :SYLLABLE 4 MARK sm4 |
| | : | : : |
| | 0007F | : : |
| BANK 1 | 00080 | :SYLLABLE 1 MARK sm1 |
| | 00081 | :SYLLABLE 2 MARK sm2 |
| | 00082 | :SYLLABLE 3 MARK sm3 |
| | 00083 | :SYLLABLE 4 MARK sm4 |
| | : | : : |
| | 000FF | : : |
| BANK 2 | 00100 | :SYLLABLE 1 MARK sm1 |
| | 00101 | :SYLLABLE 2 MARK sm2 |
| | 00102 | :SYLLABLE 3 MARK sm3 |
| | 00103 | :SYLLABLE 4 MARK sm4 |
| | : | : : |
| | 0017F | : : |

FIG.4

<PARAMETER 3 STORAGE UNIT : CUT ADDRESS REGION>

| | ADDRESS : DATA | |
|---|---|---|
| BANK 0 | 0000 | :WAVEFORM READ END ADDRESS wea |
| | 0001 | :CUT START ADDRESS 1 : csa1 |
| | 0002 | :CUT START ADDRESS 2 : csa2 |
| | 0003 | :CUT START ADDRESS 3 : csa3 |
| | : | : |
| | | :WAVEFORM READ END ADDRESS wea |
| BANK 1 | 0800 | :WAVEFORM READ END ADDRESS wea |
| | 0801 | :CUT START ADDRESS 1 : csa1 |
| | 0802 | :CUT START ADDRESS 2 : csa2 |
| | 0803 | :CUT START ADDRESS 3 : csa3 |
| | : | : |
| | | :WAVEFORM READ END ADDRESS wea |
| BANK 2 | 1000 | :WAVEFORM READ END ADDRESS wea |
| | 1001 | :CUT START ADDRESS 1 : csa1 |
| | 1002 | :CUT START ADDRESS 2 : csa2 |
| | 1003 | :CUT START ADDRESS 3 : csa3 |
| | : | : |
| | | :WAVEFORM READ END ADDRESS wea |

FIG.5

<WAVEFORM DATA STORAGE UNIT>

| | ADDRESS | : DATA |
|---|---|---|
| BANK 0 | 00000 – 07FFF | : WAVEFORM DATA wd |
| BANK 1 | 08000 – 0FFFF | : WAVEFORM DATA wd |
| BANK 2 | 10000 – 17FFF | : WAVEFORM DATA wd |

FIG.6

- BANK NUMBER BN
- WAVEFORM NAME WN
- SAMPLING FREQUENCY SR
- ORIGINAL PITCH OP
- ORIGINAL PITCH SHIFT VOLUME OPSV
- OUTPUT LEVEL OL
- FORMANT SHIFT VOLUME FSV
- SET TIME COMPANDING VOLUME STCV
- DEPTH OF PITCH MODULATION DPM
- DEPTH OF FORMANT MODULATION DFM
- DEPTH OF VELOCITY LEVEL MODULATION DLM
- TIME COMPANDING MODULATION VOLUME(COEFFICIENT) TCMV
- PITCH RATIO PR
- VELOCITY LEVEL VL
- LFO GATE VALUE LG
- CPU SYLLABLE FLAG CSF

FIG.7

- NOTE NUMBER NN
- VELOCITY V
- NOTE ON/OFF NT
- AFTER-TOUCH VOLUME ATV
- OLD AFTER—TOUCH VOLUME OATV
- MODULATION LEVER VOLUME MLV

FIG.8

KEY INFORMATION REGISTER

- PITCH RATIO pr
- FORMANT SHIFT VOLUME fsv
- VELOCITY LEVEL vl
- TIME COMPANDING VOLUME tcv
- CUT ADDRESS POINTER cap
- BANK NUMBER bn : BANK NUMBER OF WAVEFORM MEMORY

FIG.9

- WAVEFORM READ END ADDRESS wea
- PLAYING POSTION pp
- NEXT CUT START ADDRESS ncsa
- FIRST/SECOND CUT START ADDRESS fcsa/scsa
- CUT WAVEFORM PITCH cwp
- REPRODUCTION PITCH (WIDTH) ppw
- REPRODUCTION PITCH COUNTER ppc
- GATE VALUE g
- FIRST/SECOND ADDRESS COUNTER ac1/ac2
- FIRST/SECOND ENVELOPE WINDOW ew1/ew2
- FIRST/SECOND WINDOW COUNTER WC1/WC2
- IDENTIFICATION FLAG f
- SYLLABLE MARK POINTER smp
- DSP SYLLABLE FLAG dsf
- NEXT SYLLABLE START ADDRESS nssa
- WINDOW LENGTH w1 : WINDOW LENGTH OF ENVELOPE WINDOW
- FIRST/SECOND WAVEFORM READ ADDRESS wra1/wra2
- OUTPUT ENVELOPE LEVEL oe1
- WAVEFORM OUTPUT wo
- PLAYING WAVEFORM OUTPUT pwo

CPU MAIN ROUTINE

DESCRIPTION OF REC PROCESS

DESCRIPTION OF EDIT PROCESS

DESCRIPTION OF PLAY PROCESS

ASSIGNMENT PROCESS TO VOICE MODULE

AFTER – TOUCH PROCESS

DEVICE AND METHOD FOR REPRODUCTION OF SOUNDS WITH INDEPENDENTLY VARIABLE DURATION AND PITCH

BACKGROUND OF THE INVENTION

1. Field of the Invention

The present invention relates to a waveform generation device and, more particularly, to a waveform generation device for use with an electronic musical instrument, which is so adapted as to read and reproduce waveform data of various sounds and voices stored in a memory.

A such waveform generation device can be used for such an electronic musical instrument called, for example, a sampler.

2. Description of the Related Art

Heretofore, a waveform generation device is generally arranged to vary a waveform reading velocity, i.e. a velocity of reading clocks, from a memory, in accordance with a reproducing velocity of reproducing the waveform by making the reproducing velocity faster or slower than a recording velocity (a recording time) for recording an original waveform, upon reproducing the recorded waveform. This technique, however, suffers from the difficulty that a pitch of the reproduced waveform has changed from that of the original waveform.

In order to solve the difficulty prevailing in the such conventional technique, there has been employed techniques which utilize a time stretch technique for waveform data. The techniques involve subjecting waveform data of a memory to compressing or expanding in accordance with a reproduction time and reproducing the waveform data previously formed with the time stretched. The techniques, however, require performing the process for the time stretch previously, so that it has the problem that it cannot be controlled optionally at a real time. Further, it suffers from another difficulty that the reproduction time is also caused to vary when the reading velocity for reading the waveform data is varied in order to change a reproduction pitch of the waveform data that has been subjected to the time stretch processing. The conventional time stretch techniques as described hereinabove present the problems that the compression of the time axis and the change of the pitch cannot be controlled independently from each other and at a real time.

Further, another technique has been proposed to solve the problems involved in the conventional techniques, which is concerned with a process comprising changing a reproduction time by changing a reading velocity for reading a waveform from a memory and correcting the change of a pitch of the reproduced waveform resulting from the change of the reproduction time with a pitch conversion device. This technique can control the reproduction time at a real time, however, a conversion capability of the pitch conversion device is so low and the reproduction time to be controlled is restricted to a very narrow range. In particular, it may cause inconveniences when the reading velocity of reading a waveform is to be made slower.

This pitch conversion device has further the problem that the original waveform data cannot be reproduced, for example, in instances where the reading velocity of the memory is made slow to perform a control using a long reproduction time.

Furthermore, such a technique suffers from the difficulty that it requires a very complicated control when it is intended to perform the control of the reproducing velocity (reproduction time) and the control of the reproduction pitch independently from each other, because the pitch conversion device causes its volume of the pitch conversion to change when the reading velocity is changed.

Moreover, in a usual case, conventional pitch conversion devices simply reproduce waveforms successively at a waveform reading velocity corresponding to a pitch to be reproduced. Hence, when an instruction to stop the reproduction is issued, then the waveform reproduction is stopped in the position in which the instruction was issued. Likewise, when an instruction to resume the reproduction is issued, then the waveform reproduction is resumed from the top position at the waveform reading velocity corresponding to the pitch specified at the start time. This type of the reproduction processes simply creates a so monotonous expression of performance.

SUMMARY OF THE INVENTION

In order to solve the problems involved in the conventional techniques, the present invention has an object to provide technology that can optionally change a reproducing velocity and a pitch of a waveform at a real time.

Another object of the present invention is to provide technology that can realize the effect of a new expression and provide performance and so on rich in expression, which can stop and resume the development of the reproduction of a waveform, for example, in a syllable unit or jump to a syllable to come next.

In order to achieve the objects, in an aspect of the present invention, there is provided a waveform generation device which comprises a storage means for storing waveform data of a waveform sequence with plural waveforms arranged in time series; a pitch information input means for entering pitch information concerning a pitch; a time information generation means for generating time information concerning a time varying with a changing velocity having no connection with a reproduction pitch; and a reproduction means including a read means for reading waveform data in correspondence with the pitch information and the time information, the read means being for reading the waveform data from the storage means at a reading velocity and having no connection with a changing velocity of changing the time information, and the reproduction means being for reproducing the read waveform data at a reproduction pitch corresponding to the pitch information of the pitch information input means.

In the waveform generation device in this aspect of the present invention, the reproducing velocity for reproducing a waveform sequence is determined on the basis of the changing velocity of the time information of the time information generation means and the changing velocity of the time information has no connection with the pitch. Thus, the reproduction means allows an independent adjustment of the reproducing velocity of the waveform sequence and the reproduction pitch when the waveform data is read in correspondence with the time information and the pitch information, at the reading velocity having no connection with the changing velocity of the time information and the resulting waveform data is reproduced at the reproduction pitch specified by the pitch information.

The waveform generation device may be further provided with a first control information input means for entering first control information for changing the changing velocity of the time information; wherein the time information generation means has a means for changing a changing velocity of the time information in accordance with the first control information to be entered. The first control information may be generated or issued, for example, by the operation of a time companding operation unit for setting a value in advance or a modulation lever or the like to be operated at a real time.

Further, the waveform generation device may have the time information generation means composed of a counter which is configured so as to change its stepping volume on the basis of the first control information.

With the arrangement of the waveform generation device in the manner as described hereinabove, the changing velocity of the time information can be changed by the first control information to be entered by the first control information input means in the manner as described hereinabove, thereby capable of optionally changing the reproducing velocity of the waveform sequence. In this case, too, the reproduction pitch is not changed by the reproducing velocity.

The waveform generation device in this aspect of the present invention may further be provided with the read means which is so configured as to read a waveform segment containing a waveform of at least one cycle of a position indicated by the time information in a cycle corresponding to the pitch information and at a reading velocity having no connection with the changing velocity of the time information and to convert the waveform data into the reproduction pitch with a formant retained therein.

This arrangement of the waveform generation device according to the present invention can reproduce the reproduction pitch, with the formant properties retained herein as they are, by reading the waveform at the same velocity as when the waveform is sampled, as the reading velocity for reading the waveform segment containing a waveform of at least one cycle.

Moreover, in this aspect, the waveform generation device of the present invention may be provided with the read means which has two processing systems; in which each processing system is configured to generate a waveform of at least one cycle of the waveform data at a cycle corresponding to a two-fold length of the reproduction pitch and then to convert the waveform data of the waveform segment into the reproduction pitch by eventually adding output from the two processing systems to each other.

The waveform generation device in this aspect of the present invention may further be provided with the formant change information input means for entering the change information for changing the formant of the waveform of the waveform sequence; in which the read means is so configured as to perform the control to make the reading velocity for reading the waveform data of the waveform segment slower when the change information is information to shift the formant thereof to the low region side and to perform the control to make the reading velocity of the waveform data thereof faster when the change information is information to shift the formant thereof to the high region side.

With the arrangement of the waveform generation device, the formant of the waveform to be reproduced can be shifted to the higher region side or to the lower region side by entering the change information by the formant change information input means.

In another aspect of the present invention, there is provided with a waveform generation device which comprises a storage means for storing waveform data of a waveform sequence with plural waveforms arranged in time series; a reproducing velocity information input means for entering a reproducing velocity information representing a reproducing velocity of the waveform data; a pitch information input means for entering a pitch information; and a reproduction means for reproducing the waveform data of the storage means at the reproducing velocity corresponding to the reproducing velocity information and at the pitch corresponding to the pitch information; wherein the storage means stores the waveform data and a mark information indicating one or more positions of the waveform sequence on a time axis; and the reproduction means has a first control means for performing a control for controlling a movement of a reproduction position of the waveform data when the reproduction position of the waveform data has reached the position indicating the mark information.

The waveform generation device in this aspect of the present invention can adjust the reproducing velocity and the reproduction pitch of the waveform independently from each other. In addition, the movement of the waveform reproduction can be stopped in the position indicated by the mark information, for example, the position of each syllable.

In a further aspect of the present invention, a waveform generation device comprises a storage means for storing waveform data of a waveform sequence with plural waveforms arranged in time series; a reproducing velocity information input means for entering reproducing velocity information representing a reproducing velocity of the waveform data; a pitch information input means for entering pitch information; and a reproduction means for reproducing the waveform data of the storage means at a reproducing velocity corresponding to the reproducing velocity information and at a pitch corresponding to the pitch information; wherein the storage means stores the waveform data and a mark information indicating one or more positions of the waveform sequence on a time axis; a second control information input means for entering a second control information for controlling a movement of a reproduction position is provided; and the reproduction means has a second control means for performing a control for controlling a movement of a reproduction position of the waveform data when the reproduction position of the waveform data has reached a position indicating the mark information in accordance with the second control information and for releasing a controlled status in which the movement of the reproduction position of the waveform data is controlled.

The waveform generation device in this aspect of the present invention can adjust the reproducing velocity and the reproduction pitch of the waveform independently from each other. As the second control information input means can give an instruction to stop the development of the reproduction position of the waveform and to release the stop of the development thereof in the position indicating the mark information, the player can control the development of the segments of the syllables at a real time, for example, by allowing the position indicating the mark information to comply with the segment of the syllable. This can add a rich expression to performance or the like.

In a still further aspect of the present invention, there is provided a waveform generation device which comprises a storage means for storing waveform data of a waveform sequence with plural waveforms arranged in time series; a reproducing velocity information input means for entering reproducing velocity information representing a reproducing velocity of the waveform data, a pitch information input means for entering pitch information; and a reproduction means for reproducing the waveform data of the storage means at a reproducing velocity corresponding to the reproducing velocity information and at a pitch corresponding to the pitch information, wherein the storage means stores the waveform data and a mark information indicating one or more positions of the waveform sequence on a time axis; a third control information input means for entering a third control information for controlling a movement of a reproduction position is provided; and the reproduction means has a third control means for performing a control for jumping a reproduction position of the waveform data to a position indicating the mark information in accordance with the third control information for controlling the development of the reproduction position.

The waveform generation device in this aspect of the present invention can adjust the reproducing velocity of the waveform independently from the reproduction pitch. As the third control information input means can give an instruction to jump the reproduction position of the waveform to the position indicating the mark information, the player can control the development of the segments of the syllables at a real time, for example, by allowing the position indicating the mark information to comply with the segment of the syllable. This can add a rich expression to performance or the like.

These and other objects, features and advantages of the present invention may become apparent in the course of the description that follows, with reference to the accompanying drawings.

BRIEF DESCRIPTION OF THE ACCOMPANYING DRAWINGS

FIG. 2 is a table showing an example of a data construction of a parameter 1 (status region) storage unit of a waveform memory in the waveform generation device according to the embodiment of the present invention.

FIG. 3 is a table showing an example of a data construction of a parameter 2 (syllable mark region) storage unit of the waveform memory in the waveform generation device according to the embodiment of the present invention.

FIG. 4 is a table showing an example of a data construction of a parameter 3 (cut start address region) storage unit of a waveform memory in the waveform generation device according to the embodiment of the present invention.

FIG. 5 is a table showing an example of a data construction of a waveform data storage unit of the waveform memory in the waveform generation device according to the embodiment of the present invention.

FIG. 6 is a table showing various parameters to be set in MIDI information registers in the waveform generation device according to the embodiment of the present invention.

FIG. 7 is a table showing various parameters to be set in registers on the CPU side in the waveform generation device according to the embodiment of the present invention.

FIG. 8 is a table showing various parameters to be set in key information registers on the DSP side in the waveform generation device according to the embodiment of the present invention.

FIG. 9 is a table showing various parameters to be set in registers on the DSP side in the waveform generation device according to the embodiment of the present invention.

DESCRIPTION OF THE PREFERRED EMBODIMENTS

The present invention will be described on the embodiment more in detail by way of examples with reference to the accompanying drawings.

Figure 1:
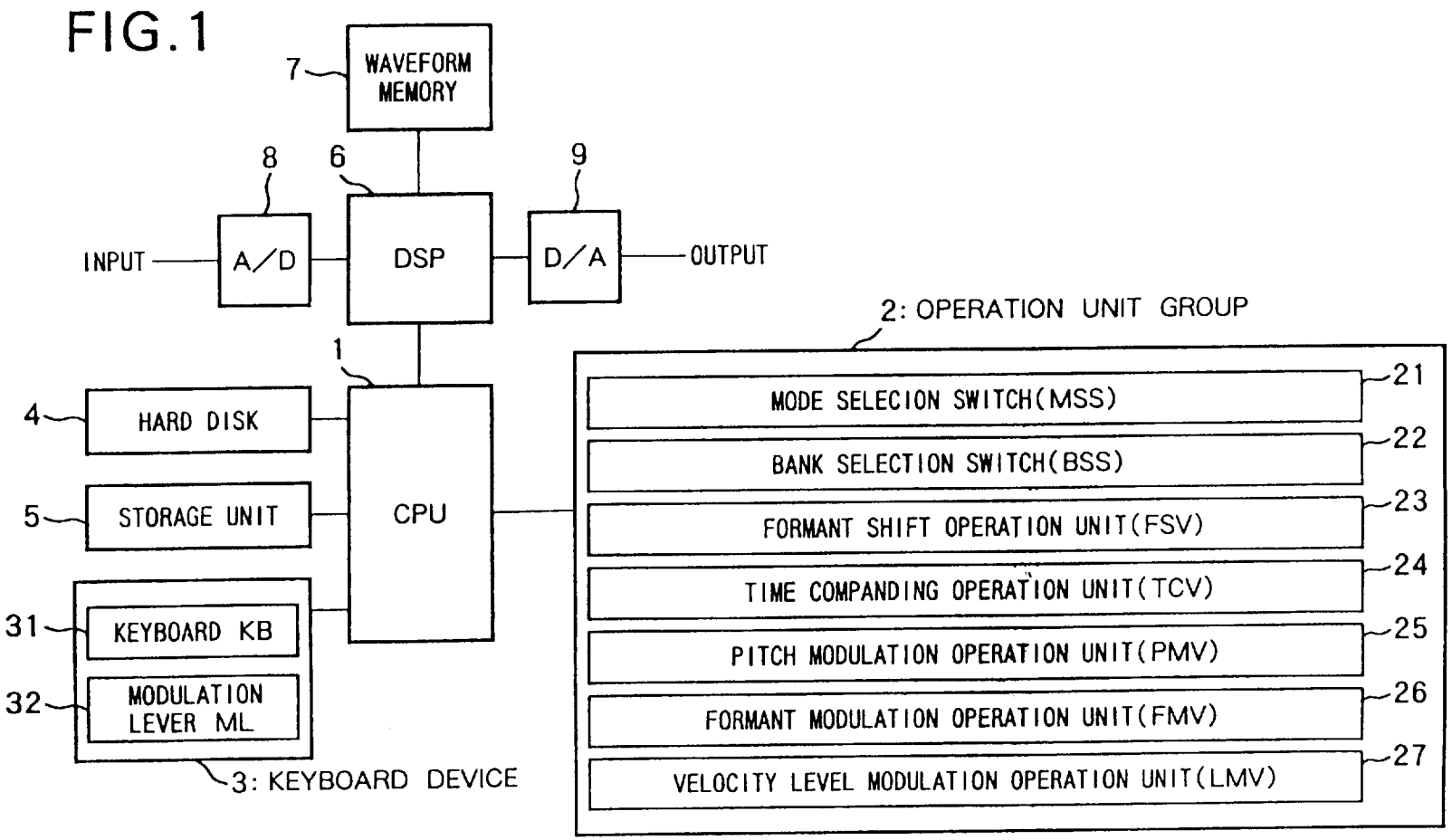
FIG. 1 is a diagram showing an entire block construction of a waveform generating device according to an embodiment of the present invention.

FIG. 1 shows a waveform generating apparatus of an electronic musical instrument according to an embodiment of the present invention. In FIG. 1, reference numeral 7 denotes a waveform memory consisting of a RAM (random access memory) for storing information relating to waveform data to be reproduced, and reference numeral 6 denotes a DSP (Digital Signal Processor) for carrying out a digital process for reproducing the waveform data of the waveform memory 7 or for effecting other processes. The DSP 6 is provided with a working memory for use in operation processes, etc. of the DSP 6 and a memory for storing programs of the DSP 6.

Further, in FIG. 1, reference numeral 8 denotes an A/D converter for effecting an A/D conversion of input analog waveform signals into digital waveform signals and entering the digital waveform signals to the DSP 6, and reference numeral 9 denotes a D/A converter for effecting a D/A conversion of the digital waveform signals to be reproduced and transferred from the DSP 6 into the analog waveform signals. The digital waveform signals entered from the A/D converter 8 are stored as waveform data in the waveform memory 7 from the DSP 6.

Moreover, as shown in FIG. 1, reference numeral 1 denotes a central processing unit (CPU) so adapted as to carry out an overall control of the apparatus, including, e.g. the control of the DSP 6, the detection of a status of an operation units group 2 and a keyboard device 3. Reference numeral 4 denotes a hard disk device of a large capacity for storing a large number of waveform data or the like and for transferring the waveform data to the waveform memory 7, as needed. Reference numeral 5 denotes a storage unit including, for example, a working memory for use in the operation process of the CPU 1 and so on, a memory for storing programs of the CPU 1, and a memory for storing programs of the DSP 6.

As shown in FIG. 1, the operation units group 2 comprises a mode selection switch (MSS) 21, a bank selection switch (BSS) 22, a formant shift operation unit (FSV) 23, a time companding operation unit (TCV) 24, a pitch modulation operation unit (PMV) 25, a formant modulation operation unit (FML) 26, a velocity level modulation operation unit (LMV) 27, and so on.

Now, a description will be made of the functions of each of the operation units as described hereinabove.

The mode selection switch (MSS) 21 is a switch for selecting one mode form a recording mode, an editing mode, and a playing (reproducing) mode. The recording mode (REC mode) is a mode for recording (sampling) musical voice signals entered from outside, the editing mode (EDIT mode) is a mode for editing a waveform recorded (sampled) in the recording mode, and the playing made (PLAY mode) is a mode for reproducing the waveform data stored in the waveform memory 7 in accordance with a playing operation of a keyboard.

The bank selection switch 22 is a switch for selecting one waveform data from plural waveform data stored in the waveform memory 7.

The formant shift operation unit 23 is an operation unit for setting a shift volume from a formant of an original waveform data stored in the waveform memory 7 and is so arranged as to set a formant shift amount FSV (referred to also as "a formant shift coefficient"), as will be described hereinafter.

The time companding operation unit 24 is an operation unit for setting a volume of compressing and expanding (hereinafter referred to as "companding") a time for determining a velocity of advancing or developing a reproduction position (a playing position) on a time axis upon reproduction of waveform data.

The pitch modulation operation unit 25 is an operation unit for specifying a depth of a pitch modulation DPM in a cent unit.

The formant modulation operation unit 26 is an operation unit for specifying a depth of a formant modulation DFM in a cent unit.

The velocity level modulation operation unit 27 is an operation unit for specifying a depth of a velocity level modulation DLM in a cent unit.

The keyboard device 3 is provided with playing operation units such as, for example, a keyboard 31 of MIDI and a modulation lever 32. The keyboard 31 is used to generate note information (note number NN, velocity V, note ON/OFF NT, etc.) corresponding to the key operated for performance and to specify a reproducing pitch and a start/stop of reproduction by turning on/off of a key upon reproduction of the waveform data stored in the waveform memory 7. Further, the keyboard 31 is also provided with an after-touch function that is so arranged as to continually generate an after-touch volume ATV of a magnitude corresponding to the intensity of depressing the key when the key was pressed and then the depressing of the key is continued. In the embodiments according to the present invention, one of the after-touch functions is so arranged as to vary its modes or reproducing waveform signals in a various way in accordance with the intensity of continually depressing the key after the key was depressed. In this case, the after-touch volume ATV is so arranged as to take a value in the range of $00 to $7F in accordance with the intensity of continually keeping the key depressed. It is to be noted herein that the symbol "$" provided as the prefix of a reference symbol, such as $7F, is intended to mean a dexadecimal representation.

The modulation lever 32 is also referred to as a modulation wheel, which in turn is an operation unit for controlling a modulation of a musical sound for generating a sound in a usual case. In this example, the modulation lever 32 is so arranged as to control a reproducing velocity (a playing velocity) without changing a pitch of a waveform to be reproduced by modifying a set time companding volume STCV set by the time companding operation unit 23 in accordance with an operation volume (a modulation lever volume MLV) of the modulation lever 32. The modulation lever 32 can generate the modulation lever volume MLV in the range of from $00 to $7F and, in a usual case, the lever is located in the center position in the movable region and generates the modulation lever volume MLV of $40 in the center position.

The waveform memory 7 is a memory in which data relating to waveform signals to be reproduced is stored, and it is divided roughly into two parts, a parameter storage unit and a waveform data storage unit. The parameter storage unit is further divided into a parameter 1 storage unit (a status region), a parameter 2 storage unit (a syllable mark region), and a parameter 3 storage unit (a cut start address region). The parameter storage unit is stored with data having an address region per bank provided in a unit of $20 address/bank for the parameter 1 storage unit (status region), $80 address/bank for the parameter 2 storage unit (syllable mark region), and $800 address/bank for the parameter 3 storage unit (cut start address region). The waveform data storage unit is stored with all waveform data of waveform numbers corresponding to the bank number per bank in a unit of $8000 address/bank. In other words, the parameter 1 storage unit is divided into each segment in every $20 address, the parameter 2 storage unit in every $80 address, and the parameter 3 storage unit in every $800 address. Further, the waveform data storage unit is divided into each segment in every $8000 address. Each segment is further provided each with a bank number in such a manner as bank 0 region, bank 1 region, bank 2 region, . . . bank n region in a numerical order from the smallest address. For example, in the case where a parameter for a waveform of a certain waveform number is stored in a bank 0 region of each of the parameter 1 storage unit, the parameter 2 storage unit and the parameter 3 storage unit, the waveform data of the waveform number is stored in the bank 0 region of the identical bank number of the waveform data storage unit corresponding to their parameters.

A description will be made of a data configuration of the parameter storage unit and the waveform data storage unit with reference to FIGS. 2 to 5, in which FIG. 2 shows a data configuration of the parameter 1 storage unit (status region), FIG. 3 a data configuration of the parameter 2 storage unit (syllable mark region), FIG. 4 a data configuration of the parameter 3 storage unit (cut start address region), and FIG. 5 a data configuration of the waveform data storage unit.

As shown in FIG. 2, the parameter 1 storage unit (status region) is stored with a waveform name wn, a sampling frequency (rate) sr, an original pitch op, an original pitch shift volume opsv from an original key, and an output level ol for every bank number, i.e. for every waveform number. The contents of these parameters are as follows:

Waveform name wn: The waveform name wn is displayed on a display device for use to readily identify a waveform stored in the memory, etc.

Sampling frequency sr: The sampling frequency sr is a frequency for sampling an original waveform (a waveform stored in the memory; this is applied to the term used in the following description) and it is used, for example, for correction so as to cause the original pitch to fail to vary when the reproduction process is to be executed at a sampling frequency different from the sampling frequency of the original waveform, etc.

Original pitch, op: The original pitch op is an original pitch of an original waveform data.

Original pitch shift volume opsv: The original pitch shift volume is a value for shifting the original pitch op (a value of magnification for varying the original pitch op) and it is used in cases, for example, where the original pitch op is varied, for example, when the original waveform data is reproduced at a pitch different from the original pitch.

Output level ol: The output level ol is to set an output level of the original waveform.

As shown in FIG. 4, the parameter 3 storage unit (cut start address region) is stored with a cut start address of a cut waveform data for every bank number. The start address csa is a top address of a waveform for a one pitch portion (hereinafter referred to as "cut waveform"). In the description which follows, the cut waveforms arranged in a time series are referred to as a waveform sequence. The start address csa is stored in a time series along the time axis for the entire waveform sequence of the waveform number involved. At the end of the region in which the cut start address is stored, the cut start address csa of the cut waveform of the last one pitch of the involved waveform sequence is stored as a waveform read end address wea. Further, at the top address of the storage region of the bank number, the waveform read end address wea of the waveform is stored as a header.

In cases where a pitch cannot be determined due to consonant portions or for other reasons, the cut start address csa stores what is determined for an entire consonant segment as:

Cut start address csa=One cut start address csa ahead+pitch, at an appropriate pitch in a cut address storage region. By the term "pitch" as defined hereinabove is meant an address width of a cut waveform having a one pitch portion. Further, by the term "appropriate pitch" is meant a pitch detected (determined) first after, for example, a consonant has been moved to a vowel.

Then, as shown in FIG. 3, the parameter2 storage unit (syllable mark region) is stored with a syllable mark of the waveform sequence for every bank number. The syllable mark sm is a mark that specifies the start of a syllable in a waveform sequence and it is represented by a boundary address between a syllable and a syllable that follows thereafter (the end address of a current syllable or the top address of a syllable to come next). In FIG. 3, a syllable 1 mark sm1, a syllable 2 mark sm2, a syllable 3 mark sm3, . . . , are each data specifying the start of a syllable, and each indicates an address number (a value indicated by a cut address pointer cap) which is stored in the same bank number of the parameter 3 storage unit (cut start address region) and which is stored with a cut start address of a top cut waveform of a syllable corresponding to each.

For example, in the case where waveform data is supposed to be a word "Roland", a cut start address csa of the top cut waveform of the waveform segment corresponding to the first syllable "Ro" is set as csa1, and a cut start address csa of the cut waveform of the waveform segment corresponding to the second syllable "la" is set as csa10, the first address $0000 of the parameter 2 storage unit (syllable mark region) is stored with an address $0001 of the parameter 3 storage unit, as syllable 1 mark sm1, which stores the cut start address csa1 of the top cut waveform of the waveform segment corresponding to the first syllable "Ro". Further, the second address $0001 of the parameter 2 storage unit (syllable mark region) is stored with an address $0010 of the parameter 3 storage unit, as syllable 2 mark sm2, which stores the cut start address csa10 of the top cut waveform of the waveform segment corresponding to the second syllable "la".

Moreover, as the last syllable mark of the bank of the parameter 2 storage unit, an address number of the parameter 3 storage unit in which a waveform read end address wea of the waveform data of each segment is stored.

Then, a description will be made of the data configuration of the waveform data storage unit with reference to FIG. 5. In the waveform data storage unit, waveform data (sampling value) wd of a waveform sequence is stored in each bank region in a sequential address order in a manner that, for instance, the waveform data of a waveform sequence of bank number (waveform number) 0 is stored in a bank 0 region of the waveform data storage unit and the waveform data of a waveform sequence of bank number (waveform number) 1 is stored in a bank 1 region thereof.

In the memory 5 on the side of CPU 1, a variety of register groups are set. FIGS. 6 and 7 each indicates various parameters to be set in those register groups. FIG. 7 indicates a register group for MIDI information. Those parameters will be described hereinafter.

Bank number NB: A bank number (waveform number) of the waveform data set with the bank selection switch 22. A waveform sequence (waveform bank) to be reproduced is selected in accordance with the bank number BN.

Various parameters of the waveform memory 7 to be stored in the parameter 1 storage unit: Such parameters include, for example, a waveform name WN, a sampling frequency (rate) SR, an original pitch OP, an original pitch shift volume OPSVPP, and an output level OL. Among those parameters, the parameters other than the original pitch have no direct connection with the working examples of the present invention, so that a description thereof is omitted from the embodiments of the present invention for brevity of explanation.

Formant shift volume FSV: A shift volume of the formant to be set with the formant shift operation unit 23. A waveform sequence in the waveform memory 7 is reproduced in the same formant as the original waveform, when this formant shift volume FSV is "1". If the formant shift volume would be greater than "1", the waveform sequence is reproduced in a state that the formant is shifted to the higher region side than the original waveform. On the other hand, if the formant shift volume would be smaller than "1", the waveform sequence is reproduced in a state that the formant is shifted to the lower region side than the original waveform.

Set time companding volume STCV: The set time companding volume STCV is to determine the magnitude of the time compression/expansion (i.e. playing velocity) upon reproduction of the waveform sequence stored in the waveform memory 7 and its numerical value is set by the time companding operation unit 24. If a waveform stored in the waveform memory 7 would not be modulated by the modulation lever 32 as will be described hereinafter, it varies with time at the same velocity as the original waveform varies with time when the set time companding volume STCV is set at "1". If the set time companding volume STCV would be greater than "1", on the one hand, it varies with time at a velocity faster than the original waveform varies so that the playing time is shortened. If the set time companding volume STCV would be smaller than "1", on the other hand, it varies with time at a velocity slower than the original waveform varies so that the playing time is extended.

Depth of Pitch Modulation DPM: The depth of pitch modulation set with the pitch modulation operation unit 25, which is set in a cent unit in the range of: $-1{,}200 \leqq$ Depth of Pitch Modulation DPM $\leqq 1{,}200$.

Depth of Formant Modulation DFM: The depth of formant modulation set with the formant modulation operation unit 26, which is set in a cent unit in the range of: $-1{,}200 \leqq$ Depth of Formant Modulation DFM $\leqq 1{,}200$.

Depth of velocity level modulation DLM: The depth of velocity level modulation set with the velocity level modulation operation unit 27, which is set in the range of: $0 \leqq$ Depth of Velocity Level Modulation DLM $\leqq 1$.

Time companding modulation volume (coefficient) TCMV: The time companding modulation volume is a value of the time companding set with the modulation lever 32 and it is a coefficient for correcting the set time companding volume STCV as described hereinabove, which is set in the range of: $0 \leqq$ Time Companding Modulation Volume TCMV $\leqq 2$.

Pitch ratio PR: The pitch ratio PPR is a ratio of a pitch corresponding to a pitch (a key number) specified by the keyboard 31 to the original pitch OP, and it is stored for every voice module.

Pitch ratio PR: The pitch ratio PPR is a ratio of a pitch corresponding to a voice height (a key number) specified by the keyboard 31 to the original pitch OP, and it is stored for every voice module.

Velocity level VL: The velocity level VL is a velocity V specified by the keyboard 31 and it is stored for every voice module.

LF0 gate value LG: The LF0 gate value LG is so arranged as to be set to "1" at the time of starting the generation of a voice and to "0" at the time of stopping the generation of the voice. This value is stored for every voice module.

CPU syllable flag CSF: A syllable flag on the CPU side to be set in correspondence with the after-touch operation.

FIG. 7 shows the register group of MIDI information which is a group of registers for storing note information entered from the keyboard device 3, and so on. The following parameters are stored therein.

Note number NN: Key number operated by the keyboard 31.

Velocity V: Velocity of the key operated by the keyboard 31.

Note ON/OFF NT: ON/OFF of the key operated by the keyboard 31.

After-touch volume ATV: The magnitude of the after-touch operation of the key operated by the keyboard 31.

Old after-touch volume OATV: The after-touch volume processed at the previous time.

Modulation lever volume MLV: The volume operated with the modulation lever 32.

An internal memory on the side of the DSP 6 is set with a variety of register groups as shown in FIGS. 8 and 9. The parameters to be set in those register groups will be described hereinafter.

First, the key information register groups are set with the parameters as set forth hereinafter. In the playing process with the CPU 1 as will be described hereinafter, the operation of the keyboard 31 is detected and the key information is transferred to the DSP 6 by an assigning process and temporarily stored in the key information register. These parameters are set in a constant cycle by an interrupt routine. These parameters may include:

Pitch ratio pr;

Formant shift volume fsv: An actual formant shift volume of a waveform to be reproduced;

Velocity level vl; and

Time companding volume tcv: An actual time companding volume of a waveform to be reproduced.

Now, a description will be made of various parameters to be used in a main routine of the DSP 6. The parameters may include:

Cut address pointer cap: A pointer pointing a cut start address csa in the cut start address region of the parameter 3 storage unit (a read address of the parameter 3 storage unit).

Bank number bn: Bank number of a waveform memory.

Waveform read end address wea: A waveform read end address stored in a bank of the parameter 3 storage unit (a cut start address of a cut waveform at the end of a waveform sequence).

Playing position pp: A pointer for indicating a current cut position for cutting a cut waveform one after another from a waveform sequence of the waveform memory.

Next cut start address ncsa: A next cut start address of a cut waveform.

First/second cut start address fcsa/scss: A current cut start address in the processing systems 1/2.

Cut waveform pitch cwp: A pitch value of a cut waveform in the current process in the processing systems 1/2, represented in an address width.

Reproduction pitch (width) ppw: A reproduction pitch for reproducing a waveform sequence stored in the waveform memory.

Reproduction pitch counter ppc: A reproduction pitch counter is to indicate a current position within one cycle of the reproduction pitch ppw.

Gate value g: A gate value is to make an output waveform muted.

First/second address counters ac1/ac2: A counter for counting read addresses of the waveform memory in the processing systems 1/2.

First/second envelope windows ew1/ew2: A window for taking a reproduced waveform by adding to a waveform sequence of the waveform memory.

First/second window counters wc1/wc2: A counter for creating an envelope window.

Identification flag f: A flag for identifying partials 1/2.

Syllable mark pointer smp: A pointer for pointing the syllable mark sm.

DSP syllable flag dsf: A syllable flag on the DSP side set corresponding to an after-touch operation.

Next syllable start address nssa: A next syllable start address followed by a current syllable.

Window length wl: A window length of an envelope window.

First/second waveform read addresses wra1/wra2: Waveform data read addresses in the processing systems 1/2.

Waveform output wo: A synthesis value of waveform output extracted by the processing systems 1/2.

Output envelope level oel: A current value of the envelope level to be multiplied by the waveform output wo.

Playing waveform output pwo: An output level of a reproduced waveform generated for actual reproduction.

A description will be described of an operation of the waveform generation device to be used in this embodiment with reference to a flowchart.

Figure 10:
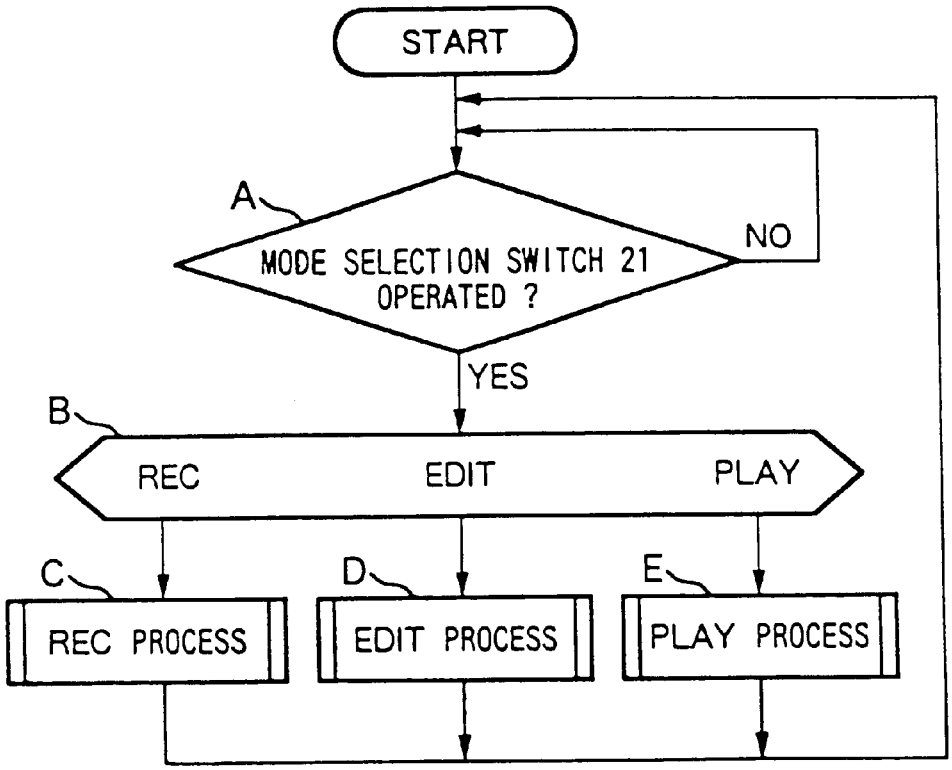
FIG. 10 is a flowchart showing a main routine in the waveform generation device according to the embodiment of the present invention.

FIG. 10 shows a flowchart of a main routine for the process to be carried out by the CPU 1.

After the main routine starts, it is monitored what mode the mode selection switch 21 was operated to select, whether a recording mode, an editing mode or a playing mode (step A), followed by deciding whether the operation selected by the mode selection switch 21 is the recording mode, the editing mode or the playing mode (step B) When the recording mode is selected, the recording (REC) mode process is executed (step C). When the editing mode is selected, the editing (EDIT) mode process is carried out (step D). When the playing mode is selected, the playing mode process is carried out (step E).

Figure 11:
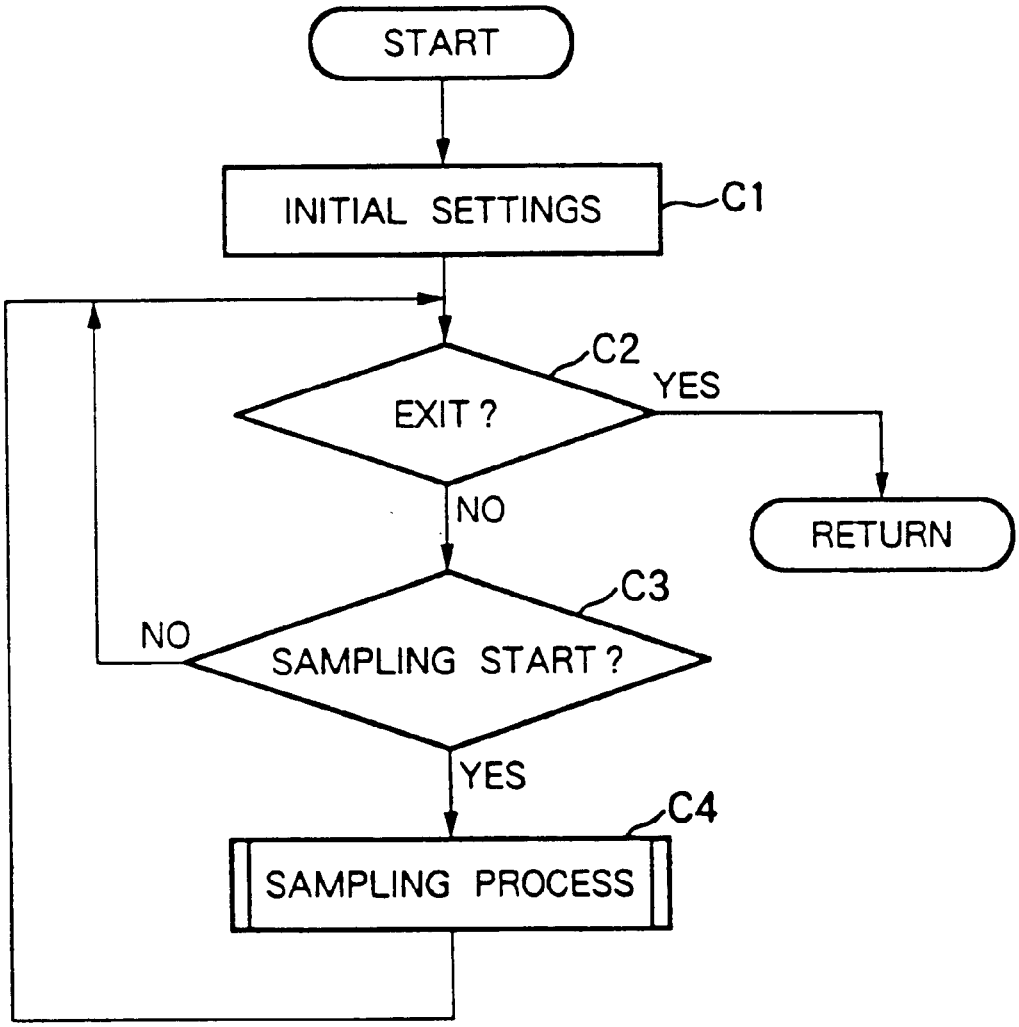
FIG. 11 is a flowchart showing a recording mode process routine in the waveform generation device according to the embodiment of the present invention.

FIG. 11 shows a flowchart of a recording mode process routine in the recording mode. The recording mode process is a process for recording (sampling) musical sound signals to be entered from outside. After the recording mode is set by the mode selection switch 21, a sampling start operation unit is operated (step C3), followed by effecting the recording by starting sampling (sampling process) (step C4). Data of sampling musical sound signals is stored in the waveform memory 7. In order to exit from the recording mode process routine and return to the main routine, an EXIT operation unit is operated (step C2).

Figure 12:
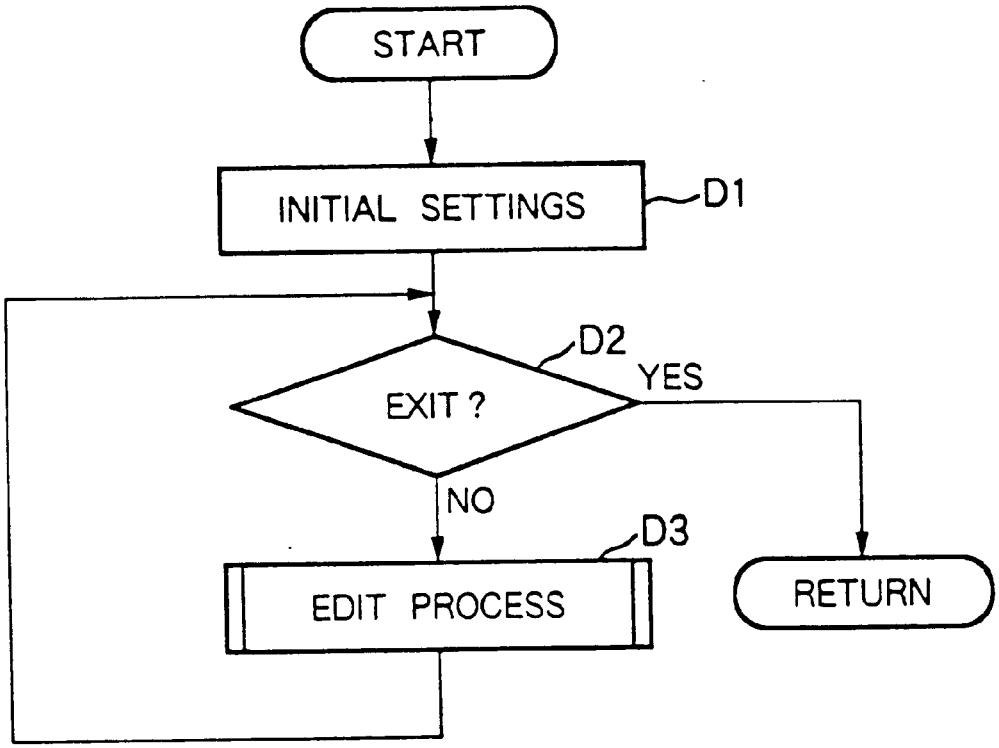
FIG. 12 is a flowchart showing an editing mode process routine in the waveform generation device according to the embodiment of the present invention.

FIG. 12 shows a flowchart of an editing mode process routine in the editing mode. The editing mode process is to execute the editing process to change a waveform sampled in the recording mode and to change reproducible waveform data and to transfer the waveform data to the hard disk device 3 and from the hard disk device 3 to the waveform memory 7 (step D3). In order to exit from the editing mode process routine, an EXIT operation unit is operated (step D2).

Figure 13:
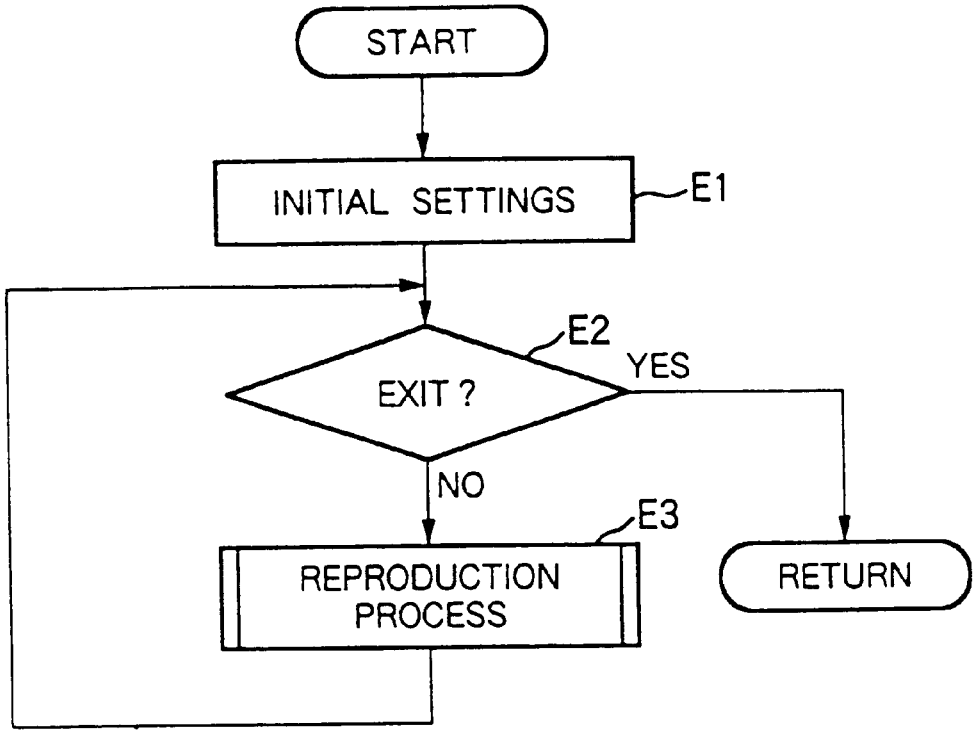
FIG. 13 is a flowchart showing a playing mode process routine in the waveform generation device according to the embodiment of the present invention.

FIG. 13 shows a flowchart of a playing mode process routine in the playing mode. In the initial setting (step El) of the playing mode process routine, a register for scanning the status of the operation unit group 2 or the like is reset to bring the operation unit group into an operable status and to set an initial status for each operation unit. By the term "initial status" is meant a status for the first standard to execute the process in the playing mode process so as to comply with the operation of an operation unit only when each operation unit varies.

The playing mode process routine is allowed to start by operating an operation unit for starting the playing after setting the playing mode by the mode selection switch 21. The playing process (step E3) is to reproduce the waveform data of the waveform memory 7 in accordance with playing information from the keyboard 31. To exit from the playing mode process routine, an EXIT operation unit is operated (step E2).

Figure 14:
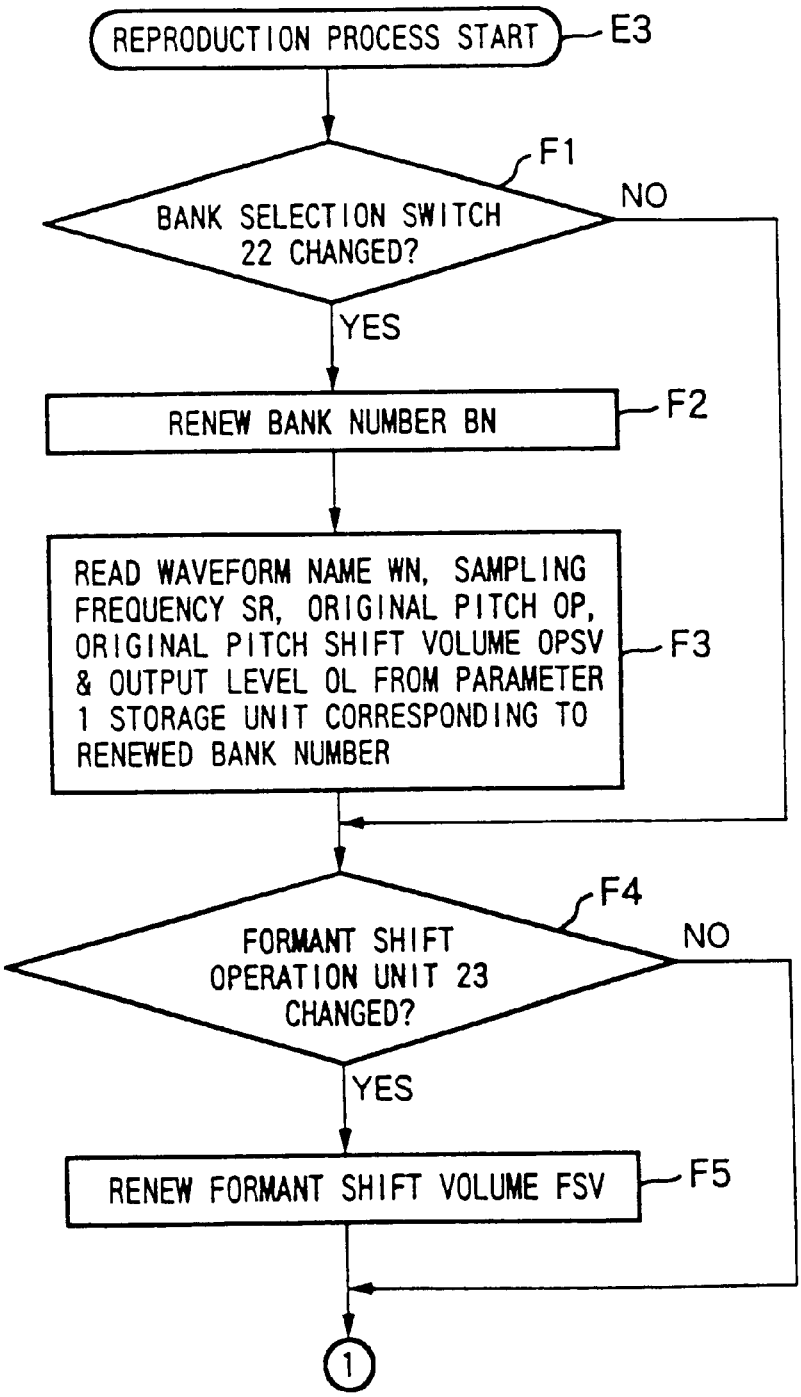
FIG. 14 is a flowchart showing a detail of the playing mode process routine (1/3) in the waveform generation device according to the embodiment of the present invention.
Figure 15:
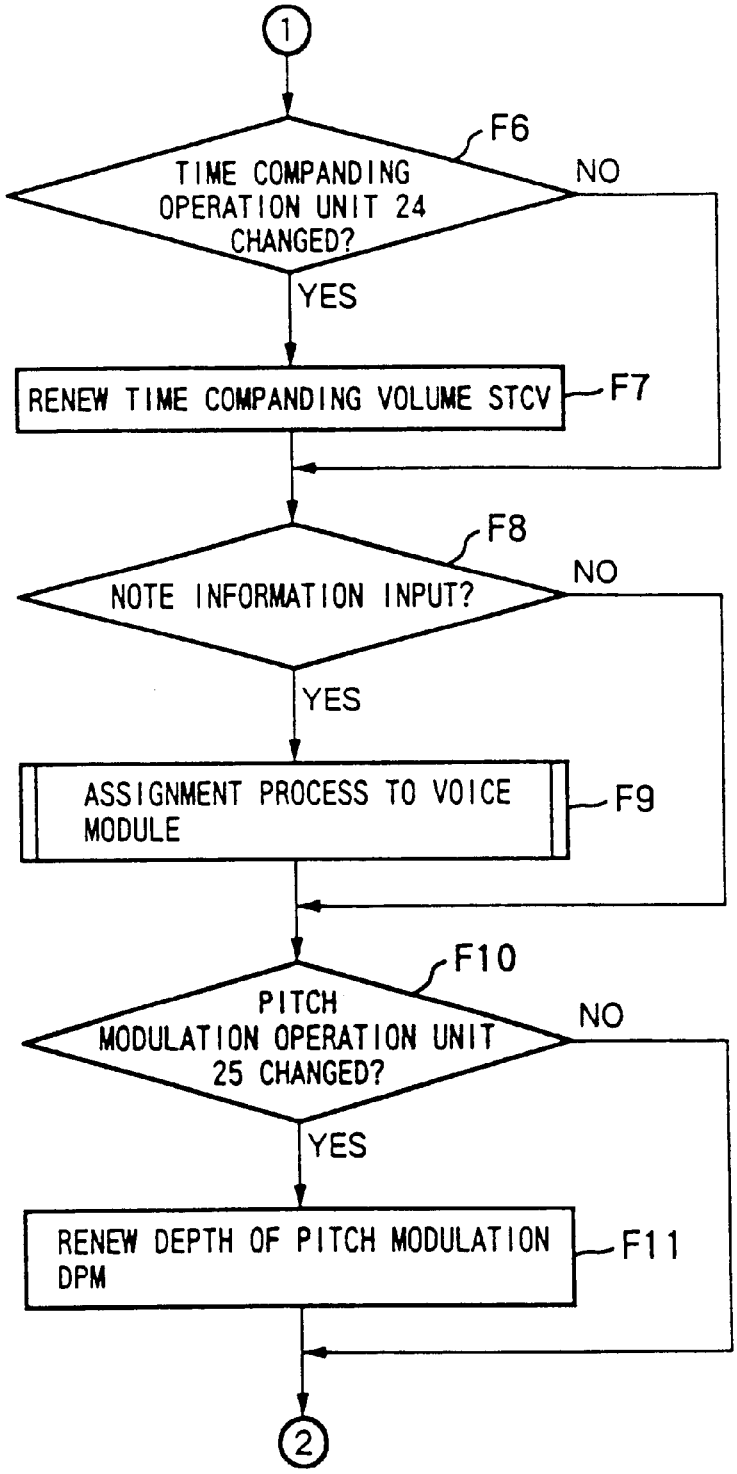
FIG. 15 is a flowchart showing a detail of the playing mode process routine (2/3) in the waveform generation device according to the embodiment of the present invention.
Figure 16:
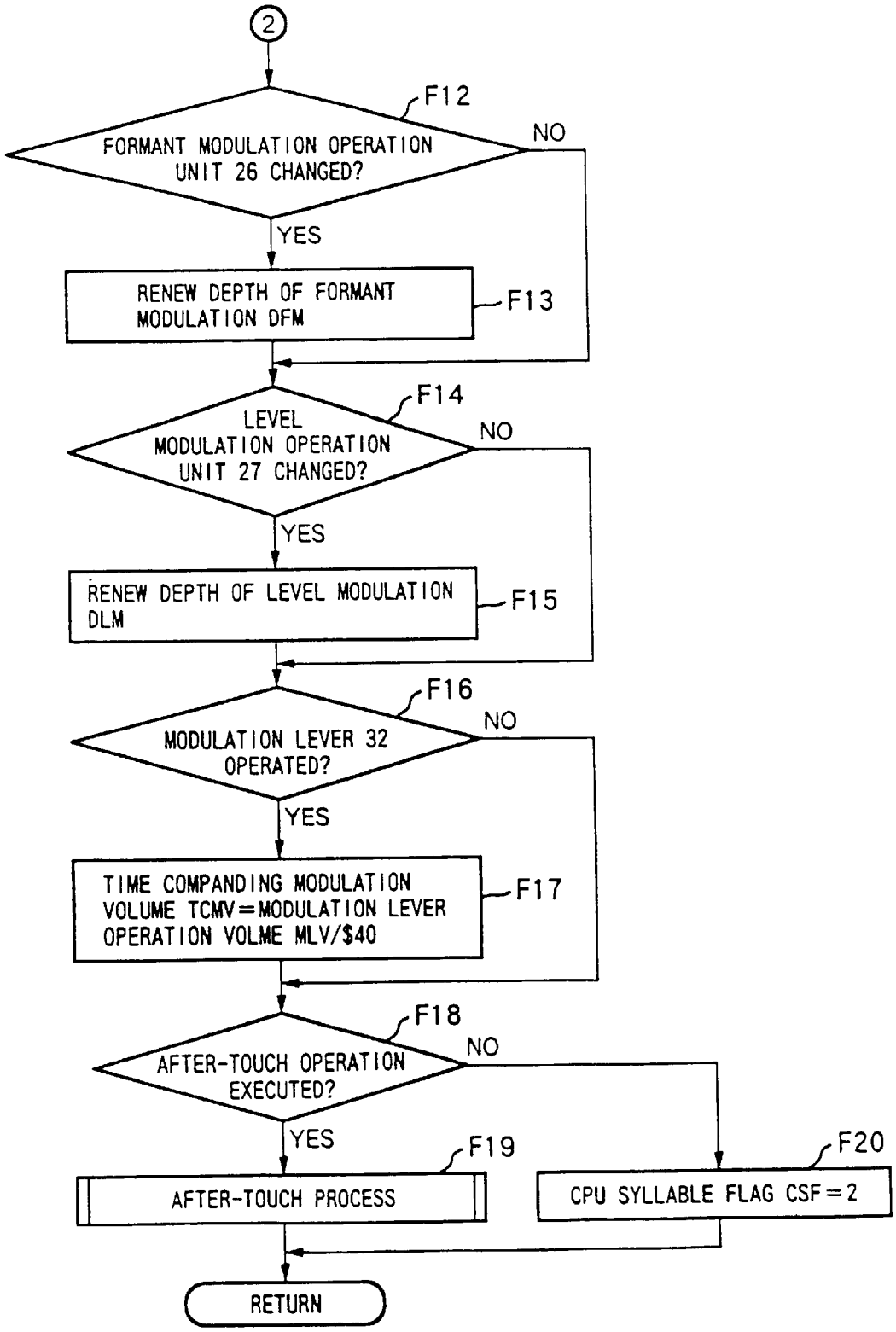
FIG. 16 is a flowchart showing a detail of the playing mode process routine (3/3) in the waveform generation device according to the embodiment of the present invention.

FIGS. 14, 15 and 16 show each detailed processing procedures of the playing process (step E3) in the playing mode. The playing process is executed by the CPU 1. In the playing mode, the contents of a register for storing the parameter corresponding to each of the setting by the operation unit group 2 and the detection of the playing operation by the keyboard 31 are renewed. Among the contents set in each of the registers, the necessary data is transferred to the register corresponding to the DSP side. In this case, the playing process is executed in a cycle longer than the main routine on the DSP side. In other words, the main routine on the DSP side is executed always once before the next playing process is executed after another playing process has been executed.

As the playing mode is started, it is decided if the bank selection switch 22 changes (step F1). When it is decided that the bank selection switch 22 has changed, the bank number BN set by the bank selection switch 22 is renewed. The waveform name wn, the sampling frequency sr, the original pitch op, the original pitch shift volume opsv, and the output level ol, each corresponding to the renewed bank number BN, are read from the parameter 1 storage unit of the waveform memory 7, followed by renewing the corresponding parameters including the waveform name WN, the sampling frequency SR, the original pitch OP, the original pitch shift volume OPSV, and the output level OL (step F3).

Then, it is decided if the formant shift operation unit 23 changes its status (step F4). When it is decided that the status of the formant shift operation unit 23 has changed, the formant shift volume FSV is renewed in correspondence thereto (step F5). Likewise, it is decided if the time companding operation unit 24 has changed (step F6), followed by renewing the set time companding volume STCV in correspondence thereto if the time companding operation unit 24 has changed (step F7).

Next, it is decided if the note information has been entered from the keyboard 31 (step FB). When it is decided that the note information has been entered, then the assignment process for assigning to a voice module is executed on the basis of the note information (step F9).

Figure 17:
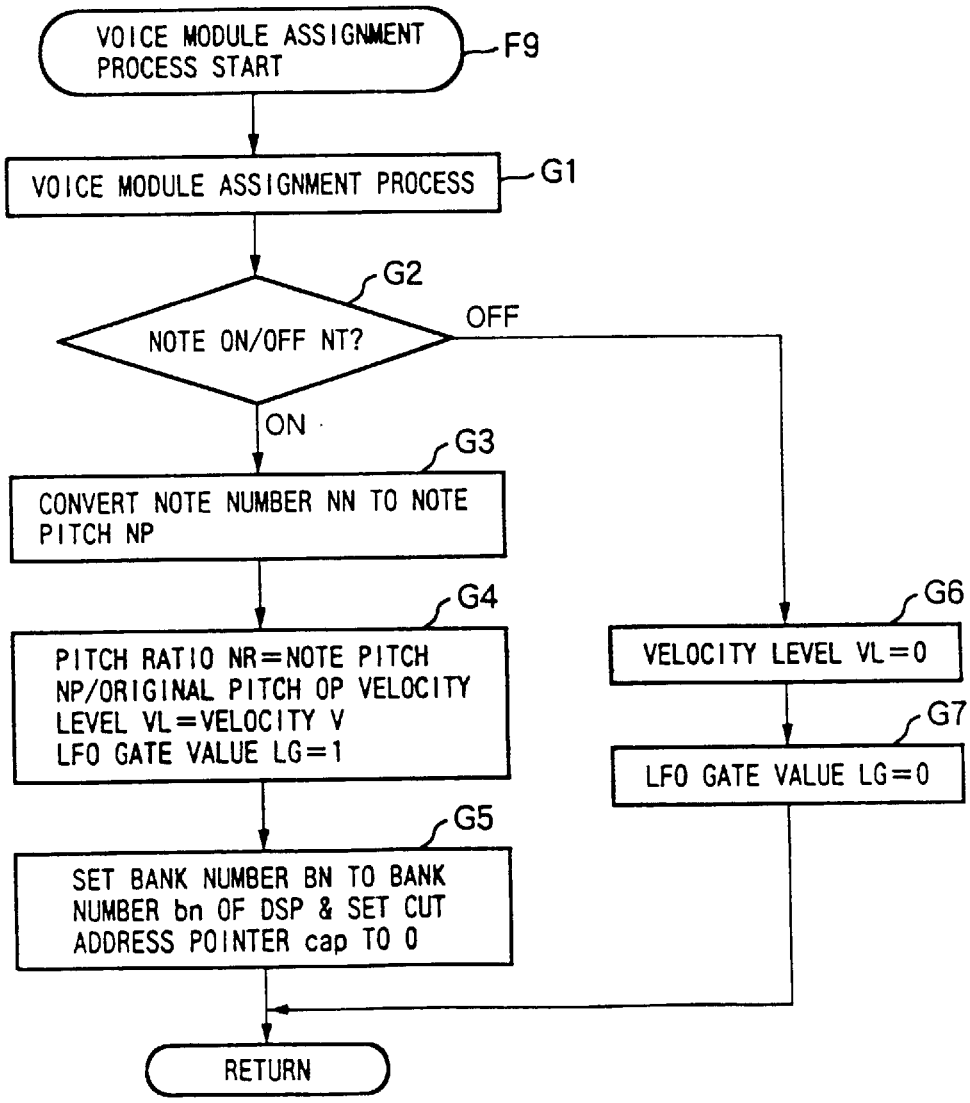
FIG. 17 is a flowchart showing a detail of an assignment process for assigning to a voice module in the playing mode process routine in the waveform generation device according to the embodiment of the present invention.

The detail of the procedures for the assignment process for assigning to the voice module is indicated in the assignment process for assigning to the voice module as shown in FIG. 17. The voice module assignment process is an assignment process for assigning to a voice module the note information (note name NN, velocity V, and note ON/OFF NT). When the note ON information is entered, then the note information entered last is assigned with priority to the voice module or the note OFF information is assigned to the voice module in order to turn the note already assigned off (step G1). The detail of the contents of the assignment process is omitted from the following description because it has no direct connection with the present invention.

In a routine for the assignment process to the voice module, after the assignment of the note information to the voice module (step G1), it is then decided if the note ON/OFF NT is a note ON information or a note OFF information (step G2). When it is decided that the note information is the note ON information, then the note number NN in the note information is converted to a note pitch NP (step G3). On the basis of the note pitch NP, a pitch ratio PR of the note pitch NP to the original pitch OP is determined by the follows:

Pitch ratio *PR*=Note pitch *NP*/Original Pitch *OP*.

Then, the pitch ratio PR is set. Further, the velocity V in the note information is set as the velocity level LV as follows:

Velocity level *VL*=Velocity *V*.

Moreover, the LF0 gate value LG is set to "1" (step G4) as follows:

*LF*0 gate value *LG*=1.

By setting the LF0 gate value LG to "1", the LF0 modulation becomes shallow at the time of the note ON and the depth of modulation becomes deeper as the time lapses.

Further, in order to reflect the original pitch shift volume OPSV, too, the above step G4 is set as follows:

Pitch ratio *PR*=Note pitch *NP*/(Original pitch *OP*×Original pitch shift volume *OPSV*);

Velocity level *VL*=Velocity *V*;

and

*LF*0 gate value *LG*=1.

Moreover, the bank number BN set by the bank selection switch 22 on the CPU side is sent to the DSP side and set as the bank number bn, and the cut address pointer cap on the side of the DSP 6 is set to "0" (step G5).

On the other hand, if the note ON/OFF NT is decided to be the note OFF information, the velocity level is set to "0" (step G6) as follows:

Velocity level *VL*=0.

Then, the LF0 gate value LG is set to "0" (step G7) as follows:

*LF*0 gate value *LG*=0.

By setting the LF0 gate value LG to "0", a degree of modulation of the LF0 modulation as will be described hereinafter becomes zero. In other words, no LF0 modulation is effected.

When the routine for the assignment process to the voice module was finished, then it is decided whether the pitch modulation operation unit 25 changes or not (step F10). If it is decided that the pitch modulation operation unit 25 changes, the depth of the pitch modulation DPM is renewed in accordance with the change of the pitch modulation operation unit 25 (step F11). Then, it is decided if the formant modulation operation unit 26 changes or not (step F12). When the decision is made that the formant modulation operation unit 26 changes, the depth of the formant modulation DFM is renewed in accordance with the change of the formant modulation operation unit 26 (step F13). Next, it is decided whether the velocity level modulation operation unit 27 changes or not (step F14). As a result, if it is decided that the velocity level modulation operation unit 27 changes, the depth of the level modulation DLM is renewed (step F15).

Then, the decision is made if the modulation lever 32 is operated or not (step F16). When it is decided that the modulation lever 32 has been operated, the time companding modulation volume TCMV is renewed at step F17 in accordance with the following computing formula:

Time companding modulation volume *TCMV*=Modulation lever volume *LV*/$40.

The time companding modulation volume TCMV is to determine a time companding volume tcv for reproducing the waveform of the DSP 6 by modifying the set time companding volume STCV set by the time companding operation unit 24 and it is a correction coefficient for multiplication by the set time companding volume STCV. The operation of the modulation lever volume MLV/$40 is to normalize the modulation lever volume MLV (the range of $00 to $7F) of the modulation lever 32 to a value in the range of 0 to 2 and the modulation lever 32 generates $40 in the center position. When the modulation lever 32 is located in the center position, the time companding modulation volume TCMV becomes "1" and the set time companding modulation volume STCV set by the time companding operation unit 24 becomes the time companding volume tcv as it is. Further, the time companding modulation volume TCMV becomes smaller and the time companding volume tcv becomes smaller (the playing velocity (a waveform reproducing velocity) becomes slower as will be described hereinafter), as the output of the modulation lever 32 varies toward the $00 side. The time companding volume tcv becomes zero when the output is $00 (the playing velocity being suspended as will be described hereinafter). On the other hand, as the set time companding volume STCV by the modulation lever 32 varies toward the $7F side, the time companding volume tcv becomes close to two times the set time companding volume STCV (the playing velocity becomes faster as will be described hereinafter).

Then, it is decided if the after-touch operation of a key of the keyboard 31 has been carried out (step F18). Whether the after-touch operation has been conducted is decided on the basis of the magnitude of the after-touch volume ATV from the keyboard 31. In other words, if the magnitude of the after-touch volume ATV is smaller than $20, it is regarded as no after-touch operation being executed and, if the magnitude of the after-touch volume ATV is $20 or greater than $20, it is regarded as the after-touch operation being executed.

When the decision is made that no after-touch operation has been carried out, the CPU syllable flag CSF is set to "2" (step F20) to return from the playing process routine to a playing mode process routine of FIG. 13. When it is decided that the after-touch operation has been conducted, then the after-touch process is carried out (step F19), followed by returning to the playing mode process routine. In the after-touch process, the set value of the CPU syllable flag CSF is changed in accordance with the magnitude of the after-touch volume ATV. The CPU syllable flag CSF is a flag to deliver information from the CPU side to the DSP side and it takes values "0", "1" and "2". In accordance with these values, a mode of the waveform reproduction process on the DSP side is varied.

Then, a description will be made of each mode of the waveform reproduction process in accordance with the CPU syllable flag CSF.

(1) The status in which the CPU syllable flag CSF is "0" is a mode when a strong after-touch has been made (after-touch volume ATV of $60 or greater) and it means the process to successively execute the waveform reproduction in current process up to the next syllable (i.e. the top of the syllable that follows next) and to continue the reproduction by stopping the advancement of the waveform reproduction as the waveform reproduction has reached the top of the next syllable. This process is hereinafter referred to as "syllable stop process". Once the advancement of the waveform reproduction has been stopped, the waveform of the waveform segment in the position to stop the waveform reproduction is reproduced in a repeated manner.

(2) On the other hand, the status in which the CPU syllable flag CSF is "1" is a mode in which the magnitude of the after-touch has temporarily been weakened (after-touch volume ATV of $40 or greater yet smaller than $60) after the strong after-touch (after-touch volume ATV of $60 or greater) and it is the process to execute the waveform reproduction in current progress to jump to the next syllable, i.e. the top of the syllable that follows next, without executing the waveform reproduction therebetween and to continue the execution of the waveform reproduction from the top of the next syllable. This process is hereinafter referred to as "syllable jump process".

(3) The status in which the CPU syllable flag CSF is "2" is a mode in which a weak after-touch has been made (after-touch volume ATV of lower than $40) and it means the process to execute usual waveform reproduction by successively carrying out reproduction regardless of a segment of the syllable of waveform data.

Figure 18:
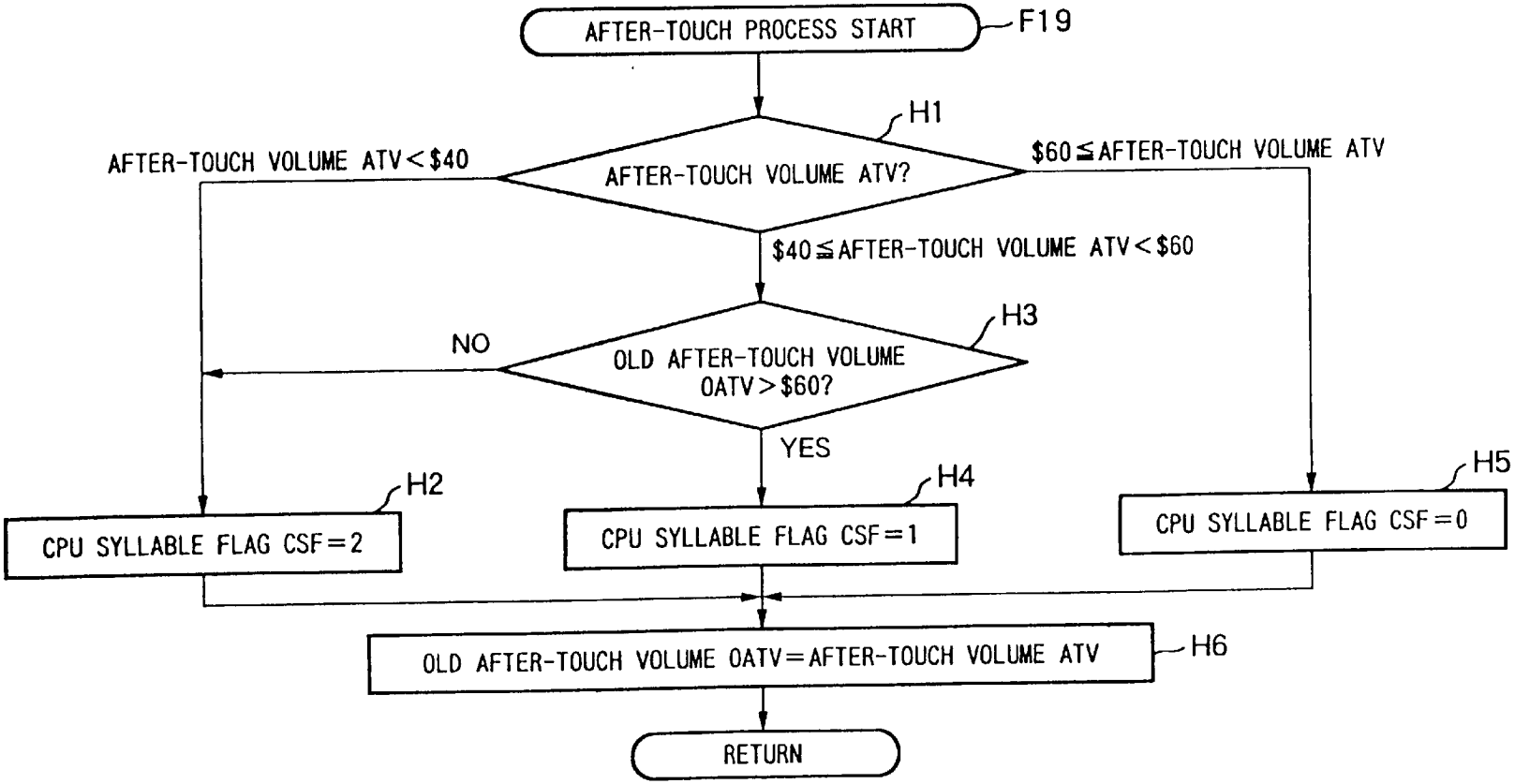
FIG. 18 is a flowchart showing a detail of an after-touch process in the playing mode process routine in the waveform generation device according to the embodiment of the present invention.

FIG. 18 shows a flowchart indicating a detail of the contents of the after-touch process of step F19. In the after-touch process, a set value of the CPU syllable flag CSF is varied in accordance with the magnitude of the after-touch volume ATV. In other words, the decision is first made of the magnitude of the after-touch volume ATV (step H1). When it is decided that the after-touch volume ATV is lower than $40, then the CPU syllable flag CSF is set to "2" indicating a usual process (step H2). On the other hand, when it is decided that the after-touch volume ATV is equal to or greater than $60, then the CPU syllable flag CSF is set to "0" indicating the syllable stop process (step H5). Further, when it is decided that the after-touch volume ATV is $40 or greater yet smaller than $60, then it is decided if the after-touch volume detected at the time of having previously executing the playing process routine, that is, old after-touch volume OATV, exceeds $60 (step H3). As a result, when the decision is made that the after-touch volume ATV is equal to or lower than $60, then the CPU syllable flag CSF is set to "2" (step H2). When it is decided that the after-touch volume ATV exceeds $60, on the other hand, the CPU syllable flag CSF is set to "1" indicating the syllable jump process (step H4). More specifically, the CPU syllable flag CSF is set to "1", that is, the syllable jump process is executed, only when the key has been strongly depressed once by the after-touch and thereafter the depressing of the key is loosened. After the setting of the CPU syllable flag CSF has been finished, the old after-touch volume OATV is renewed by the after-touch volume ATV currently detected (step H6).

In the after-touch process, the DSP main routine is executed always once after the process of setting the CPU syllable flag CSF, so that the process corresponding to the CPU syllable flaq CSF is always executed, the process being the process to renew the syllable mark sm when the CPU syllable flag CSF is "1" in a manner as will be described hereinafter.

Further, the CPU 1 executes the interrupt process in a constant cycle, as will be described hereinafter. The results of the interrupt process are transmitted to the DSP 6 and the register is set each with the pitch ratio pr, the formant shift volume fsv, the velocity volume vl, and the time companding volume tcv.

Figure 19:
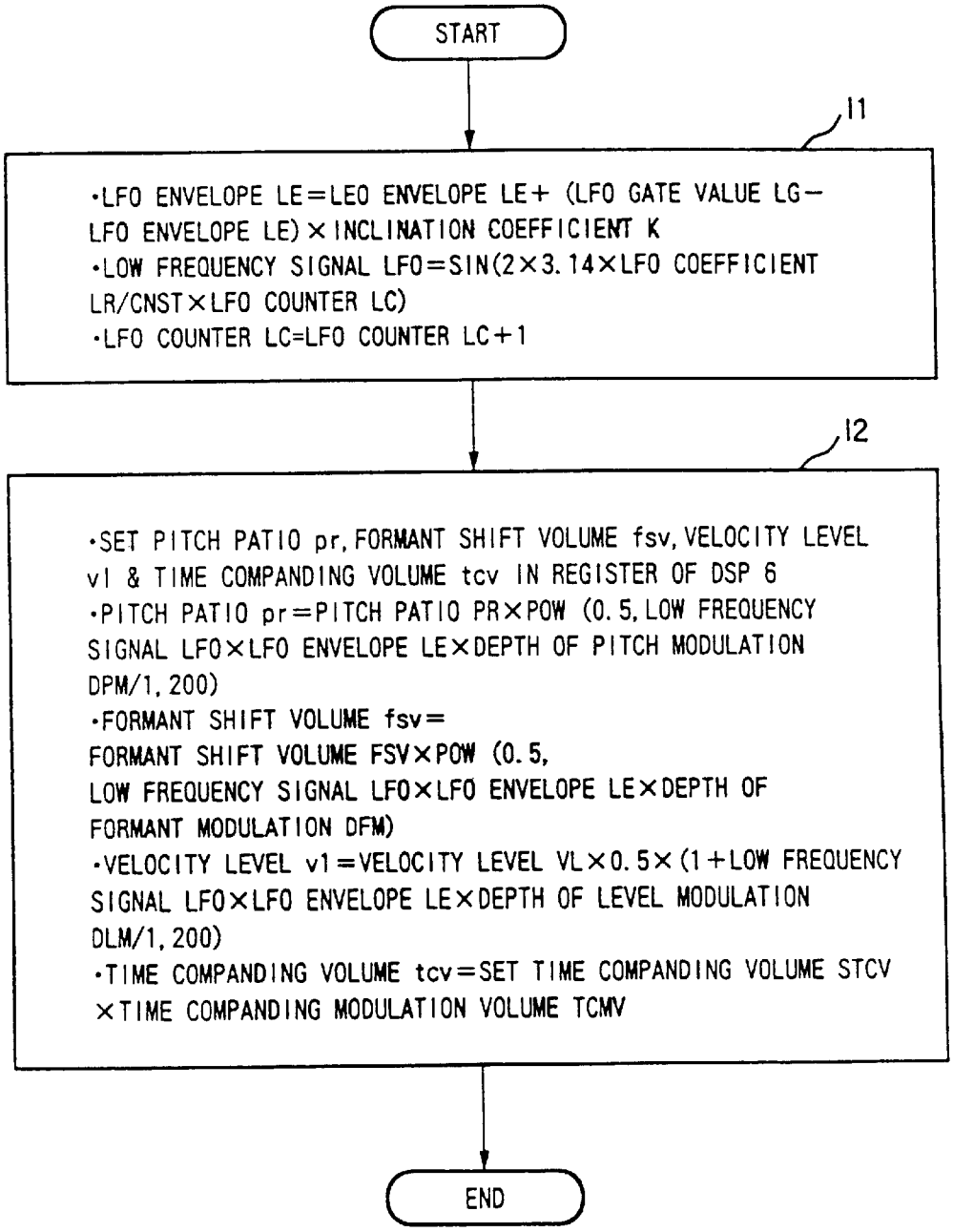
FIG. 19 is a flowchart showing a detail of an CPU interrupt process in the waveform generation device according to the embodiment of the present invention.

Then, a description will be made of an interrupt process routine with reference to FIGS. 19 and 20.

As the interrupt process has been started up, the LF0 envelope will be first computed. In other words, the LF0 envelope LE is given as follows:

$$LF0 \text{ envelope } LE = LF0 \text{ envelope } LE + (LF0 \text{ gate volume } LG - LF0 \text{ envelope } LE) \times \text{inclination coefficient } KS.$$

Figure 20:
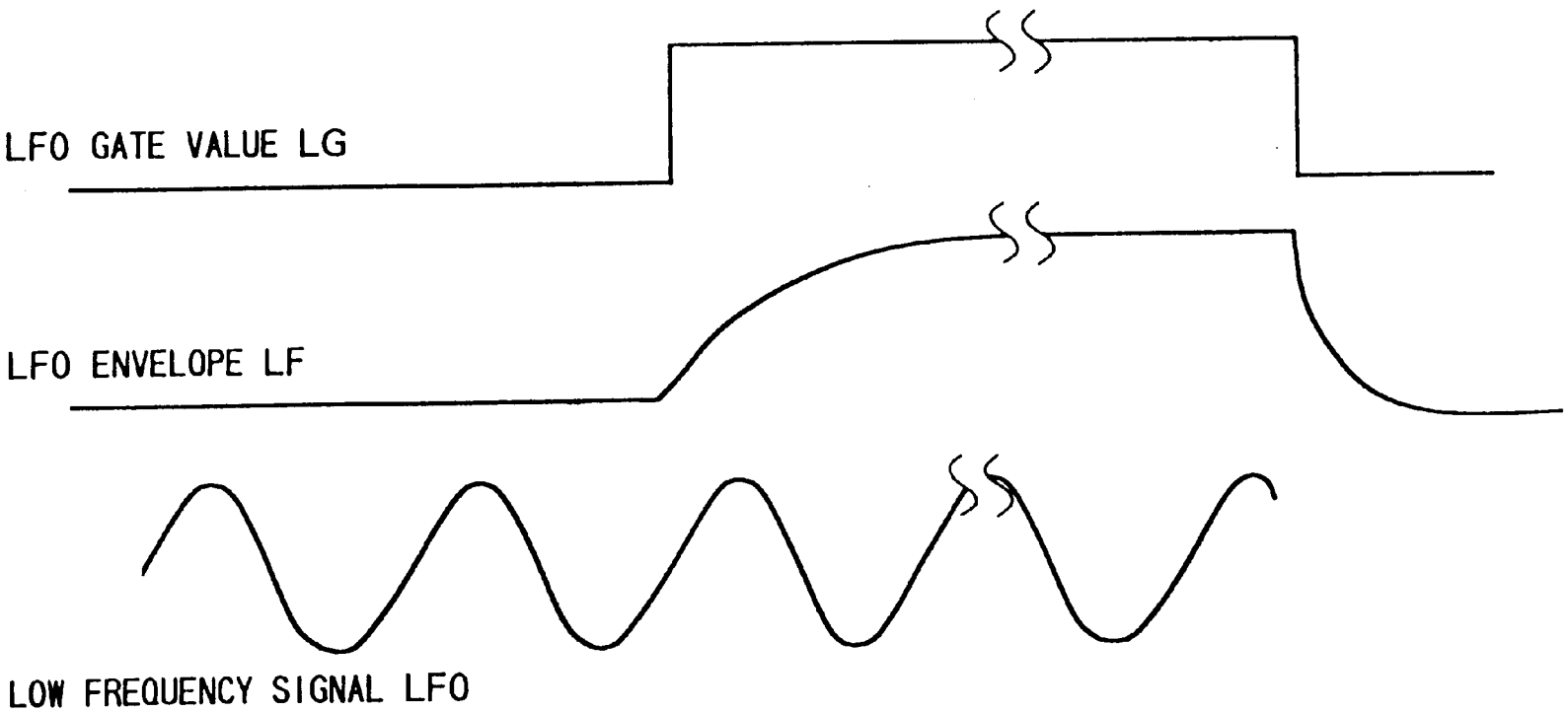
FIG. 20 is a time chart showing various waveforms of signals generated by an operation process in the CPU interrupt process routine in the waveform generation device according to the embodiment of the present invention.

FIG. 20 shows a waveform of the LF0 envelope LE. In this formula, the LF0 gate volume LG is a value that is set to "1" and "0" when the note information is decided to be note ON and note OFF in the steps G4 and G7 of the assignment process to the voice module, respectively (FIG. 17). As a consequence, the LF0 envelope LE allows the waveform to rise upward gradually at an inclination as defined by the inclination coefficient KS in response to the note ON information and it is maintained at the constant value "1" thereafter. On the other hand, the waveform is allowed to fall downward gradually at an inclination as defined by the inclination coefficient KS in response to the note OFF information.

Further, an operation for generating a low frequency signal LF0 is executed by the following formulas:

$$\text{Low frequency signal } LF0 = \text{SIN}(2 \times 3.14 \times LF0 \text{ coefficient } LR/CNST \times LF0 \text{ counter } LC);$$

and $$LF0 \text{ counter } LC = LF0 \text{ counter } LC + 1.$$

In these formulas, the LF0 coefficient LR is represented in a unit of Hz, CNST is a value of counts obtained for 1 second by the LF0 counter LC. The low frequency signal LF0 obtained by the above computing formulas is a sine wave as shown in FIG. 20.

Then, the pitch ratio pr, the formant shift volume fsv, the velocity volume vl, and the time companding volume tcv, each being set in the register of the DSP 6, are computed.

The pitch ratio pr is computed by the following formula:

Pitch ratio *pr*=Pitch ratio *PR*×*POW*(0.5, low frequency signal *LF*0×*LF*0 envelope *LE*×depth of pitch modulation *DPM*/1,200).

In this formula, the portion of "POW (0.5, low frequency signal LF0×LF0 envelope LE×depth of pitch modulation DPM/1,200)" represents a power of 0.5 having the portion of 'low frequency signal LF0×envelope LE×depth of pitch modulation DPM/1,200' as an exponent. When the pitch ratio pr is computed from the above formula, it is given as a value that fluctuates by the modulation of the pitch ratio PR in accordance with the depth of pitch modulation DPM set by the pitch modulation operation unit 25. In other words, if the depth of pitch modulation DPM is "0", no pitch modulation is caused, the pitch ratio PR becomes the pitch ratio pr as it is. On the other hand, when the depth of pitch modulation DPM is set in the range of from −1,200 to +1,200, except for "0", the pitch ratio pr fluctuates in accordance with the value of the depth of pitch modulation DPM, thereby modulating the pitch of the waveform to be reproduced and consequently providing a unique effect for the waveform.

Likewise, the formant shift volume fsv is computed by the following formula:

Formant shift volume *fsv*=Formant shift volume *FSV*×*POW*(0.5, low frequency signal *LF*0×*LF*0 envelope *LF*×depth of formant modulation *DFM*/1,200).

In this formula, the portion of "POW (0.5, low frequency signal LF0×LF0 envelope LF×depth of formant modulation DFM/1,200)" represents a power of 0.5 having the portion of 'low frequency signal LF0×LF0 envelope LF×depth of formant modulation DFM/1,200' as an exponent. When the formant shift volume fsv is computed from the above formula, it is given as a value that fluctuates by the modulation of the formant shift volume FSV in accordance with the depth of formant modulation DFM set by the formant shift operation unit 23. In other words, if the depth of formant modulation DFM is "0", no modulation of the formant is caused, the formant shift volume FSV becomes the formant shift volume fsv as it is. On the other hand, when the depth of formant modulation DFM is set in the range of from −1,200 to +1,200, except for "0", the formant shift volume fsv fluctuates in accordance with the value of the depth of formant modulation DFM, thereby modulating the formant of the waveform to be reproduced and consequently providing a unique effect for the waveform.

Then, the velocity level vl is likewise computed by the following formula:

Velocity level *vl*=Velocity level *LV*×0.5×(1+low frequency signal *LF*0×*LF*0 envelope *LE*×depth of velocity level modulation *DLM*).

The velocity level vl obtained by this formula gives a value that fluctuates, in which the velocity level VL is modulated in accordance with the depth of the velocity level modulation DLM to be set by the velocity level modulation operation unit 27. In other words, if the depth of the velocity level modulation DLM is "0", on the one hand, no velocity level modulation is caused and the velocity level VL becomes the velocity level vl as it is. When the velocity level VL takes a value in the range of 0<DLM≦1, on the other hand, the velocity level vl fluctuates in accordance with the value, thereby modulating the output level of the waveform to be reproduced and providing a unique effect.

Moreover, the time companding volume tcv that is a variable for determining an actual playing velocity of a waveform to be reproduced is computed by the following formula:

Time companding volume *tcv*=Set time companding volume *STCV*×time companding modulation volume *SCMV*.

In other words, the time companding volume tcv is determined by multiplying the set time companding volume STCV set with the time companding operation unit 24 by the time companding modulation volume TCMV as a correction coefficient entered with the modulation lever 32.

Figure 21:
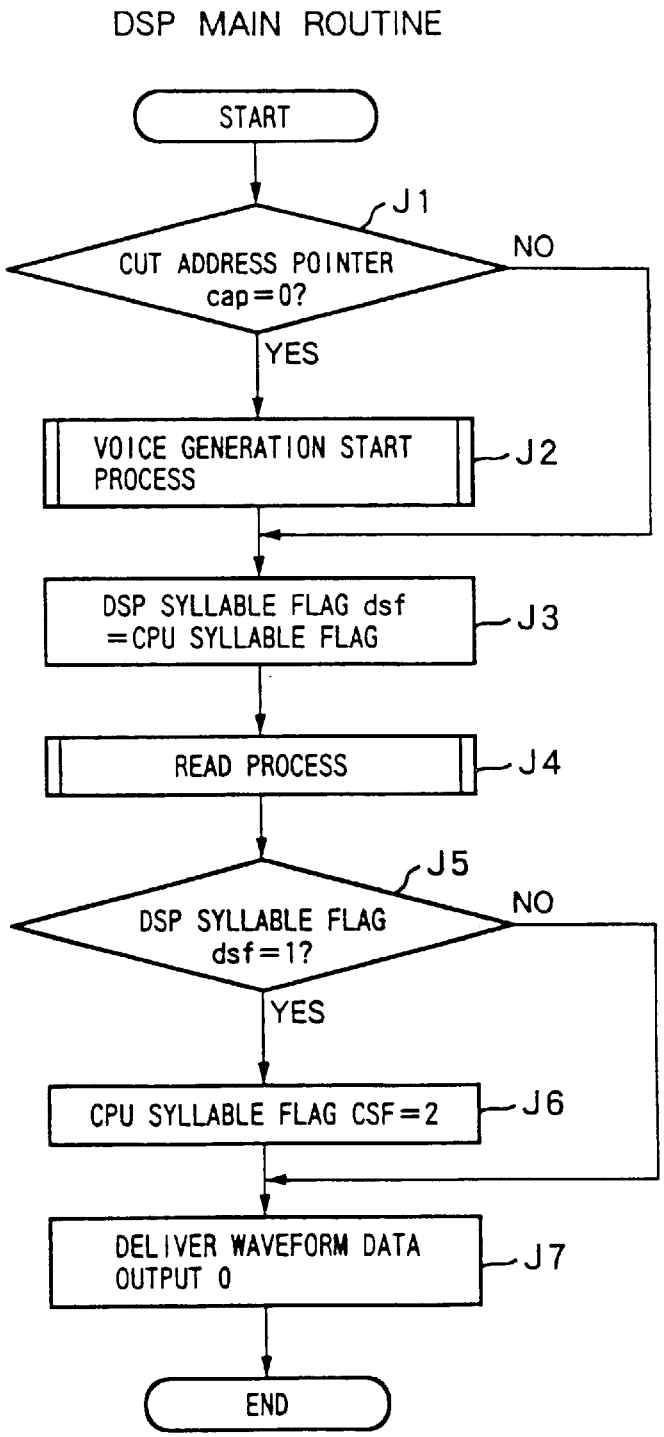
FIG. 21 is a flowchart showing a main routine in the DSP in the waveform generation device according to the embodiment of the present invention.

A description will now turn to the process of the DSP 6 to which the key information has been transferred, with reference to FIG. 21.

FIG. 21 is a flowchart indicating a main routine of the DSP 6 in order to execute it in a sampling cycle in a repeated way. On the basis of new key information transferred from the CPU 1, it is monitored whether the cut address pointer cap is set to "0" in the voice module assignment process of the CPU (step J1). When the cut address pointer cap is set to "0", a voice generation start process is executed (step J2).

Figure 22:
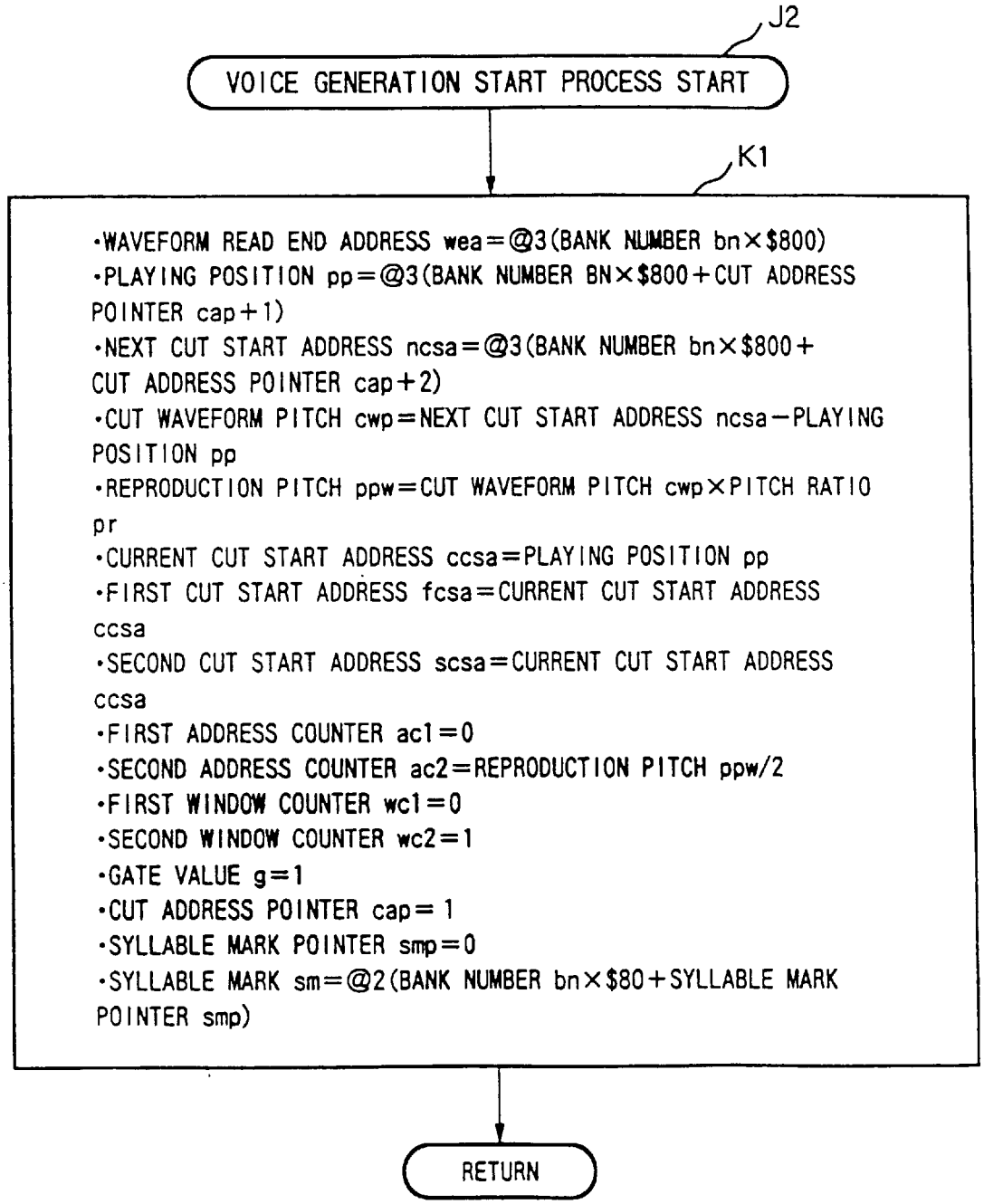
FIG. 22 is a flowchart showing a voice generation start process in the main routine in the DSP in the waveform generation device according to the embodiment of the present invention.

FIG. 22 shows the voice generation start process. The following is a description of the processes. In the following description, reference symbol "@ n (bank number bn×$ . . . " means to read data from an address of the bank number bn×$ . . . of the parameter n storage unit (n=1, 2 or 3).

Waveform read end address wea=@ 3 (bank number bn×$800)

Data is read from an address of (bank number bn×$800) (=an address stored with the waveform read end address wea) of the parameter 3 storage unit (cut start address region) and it is set as a waveform read end address wea in a register.

Playing position pp=@ 3 (bank number bn×$800+cut address pointer cap+1)

Data (cut start address csa1 of the top cut waveform of a waveform sequence) is read from an address of (bank number bn×$800+cut address pointer cap+1) of the parameter 3 storage unit and it is set as a playing position pp in a register.

Next cut start address ncsa=@ 3 (bank number bn×$800+cut address pointer cap+2)

Data (cut start address csa2 of the second cut waveform of a waveform sequence) is read from an address of (bank number bn×$800+cut address pointer cap+2) of the parameter 3 storage unit and it is set as a next cut start address ncsa in a register.

Cut waveform pitch cwp=Next cut start address ncsa−Playing position pp

A register is set with a value obtained by subtracting the set playing position pp (corresponding to the top cut start address at the time of this voice generation start process) from the next cut start address ncsa as a cut waveform pitch cwp (represented in an address width). The cut waveform pitch cwp corresponds to a pitch of a cut waveform (corresponding to the top cut waveform at the time of this voice generation start process) of a processing object.

Reproduction pitch ppw=Cut waveform pitch cwp×Pitch ratio pr.

A product obtained by multiplying the cut waveform pitch cwp by the pitch ratio pr is set as a reproduction pitch ppw in a register.

Current cut start address ccsa=Playing position pp

The playing position pp is set as a current cut start address ccsa in a register.

First cut start address fcsa=Current cut start address ccsa

The current cut start address ccsa is set in a register as a first cut start address fcsa in the first processing system.

Second cut start address scsa=Current cut start address ccsa

The current cut start address ccsa is set in a register as a second cut start address fcsa in the second processing system.

First address counter ac1=0

The first address counter ac1 is set as "0" in a register.

Second address counter ac2=Reproduction pitch ppw/2

The reproduction pitch ppw/2 (a value of a half cycle of the reproduction pitch ppw) is set as a second address counter ac2 in a register.

First window counter wc1=0

A first window counter wc1 is set as "0" in a register.

Second window counter wc2=1

A second window counter wc2 is set as "1" in a register.

Gate value g=1

A gate value g is set as "1" in a register.

Cut address pointer cap=1

The cut address pointer cap is set as "1" in a register.

Syllable mark pointer smp=0

The syllable mark pointer smp is set as "0" in a register.

Syllable mark sm=@ 2 (bank number bn×$80+syllable mark pointer smp)

Data (top syllable 1 mark sm1) is read from an address of (bank number bn×$80+syllable mark pointer smp) of the parameter 2 storage unit (syllable mark region) and it is set as a syllable mark sm in a register.

As the voice generation start process has been finished (step J2), a value of the CPU syllable flag CSF is set in the DSP syllable flag dsf (step J3), thereby delivering information on the syllable process from the CPU side to the DSP side. Thereafter, the read process is executed (step J4) as will be described hereinafter. Then, the decision is made if the DSP syllable flag dsf represents "1" indicating the syllable jump process (step J5). As a result, when it is decided that the DSP syllable flag dsf indicates "1", the CPU syllable flag CSF is then set to "2" (step J6). This is the process to return the DSP syllable flagdsf to "2" indicating the usual process from "1" indicating the syllable jump process when the DSP syllable flag dsf is set so as to allow the syllable jump process to be executed on the DSP side. When the DSP syllable flag dsf is set to "0" or "2", this step J6 is jumped. This is to execute only once the process to increment the syllable mark pointer smp upon executing the syllable jump process. Then, the playing waveform output pwo read in the read process (step J4) is generated (step J7).

The read process in the step J4 is so arranged as to convert the pitches with the formant properties of an original waveform sequence (a voice) retained as they are by cutting the cut waveforms one after another from the waveform sequence and reproducing the cut waveform at the pitch (=reproduction pitch) corresponding to a desired reproduction pitch while substantially retaining the features of the formant of the cut waveform. In this read process, the pitch of the waveform to be reproduced (=reproduction pitch) is varied with the pitch of the key depressed on the keyboard, however, the magnitude of the reproduction pitch (i.e. what key is depressed, does not exert an influence upon the playing time required for the reproduction of the waveform.

A brief description will now be made of the read process. A cut waveform having one or two pitches nearby the position specified by the playing position pp is cut one after another from the waveform sequence stored in the waveform memory 7. The cut waveform is then reproduced at a pitch and a formant different from the original waveform. Upon carrying out the read process, the reproduction of the cut waveform is executed in two processing systems (partial) concurrently, each processing system being so adapted as to reproduce the cut waveform at a cycle of a 2-fold length of the reproduction pitch sought to be reproduced in such a manner that the cut waveforms of the two processing systems deviate from each other by a half cycle, i.e. the cycle being equal to the cycle of the reproduction pitch sought to be reproduced. They are then synthesized so as to make an entire length of the overlapping cycles comply with a cycle of the reproduction pitch sought to be reproduced.

Figure 23:
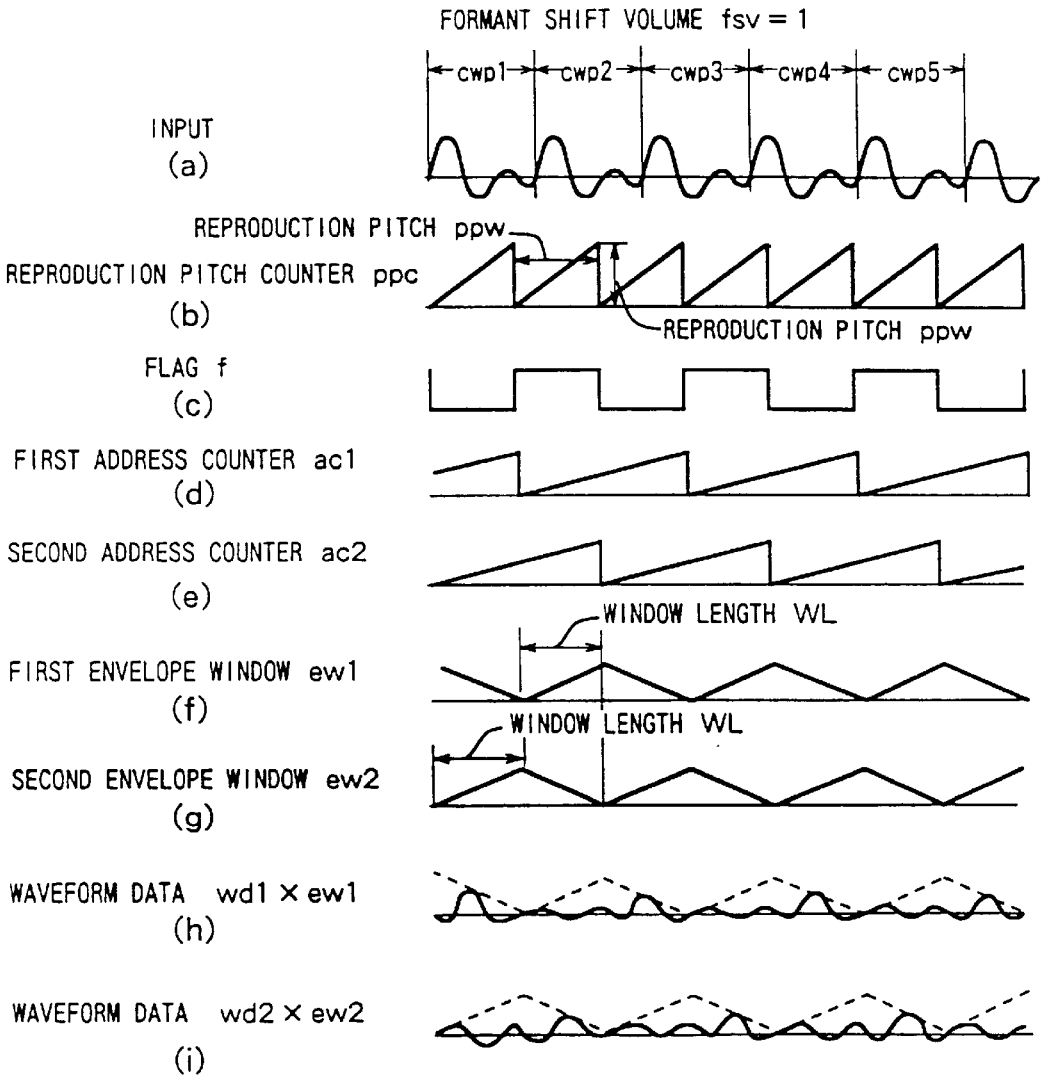
FIG. 23 is a time chart for a brief description of an action of a read process (with no changes of formant properties and a shift of a pitch to a higher region).
Figure 24:
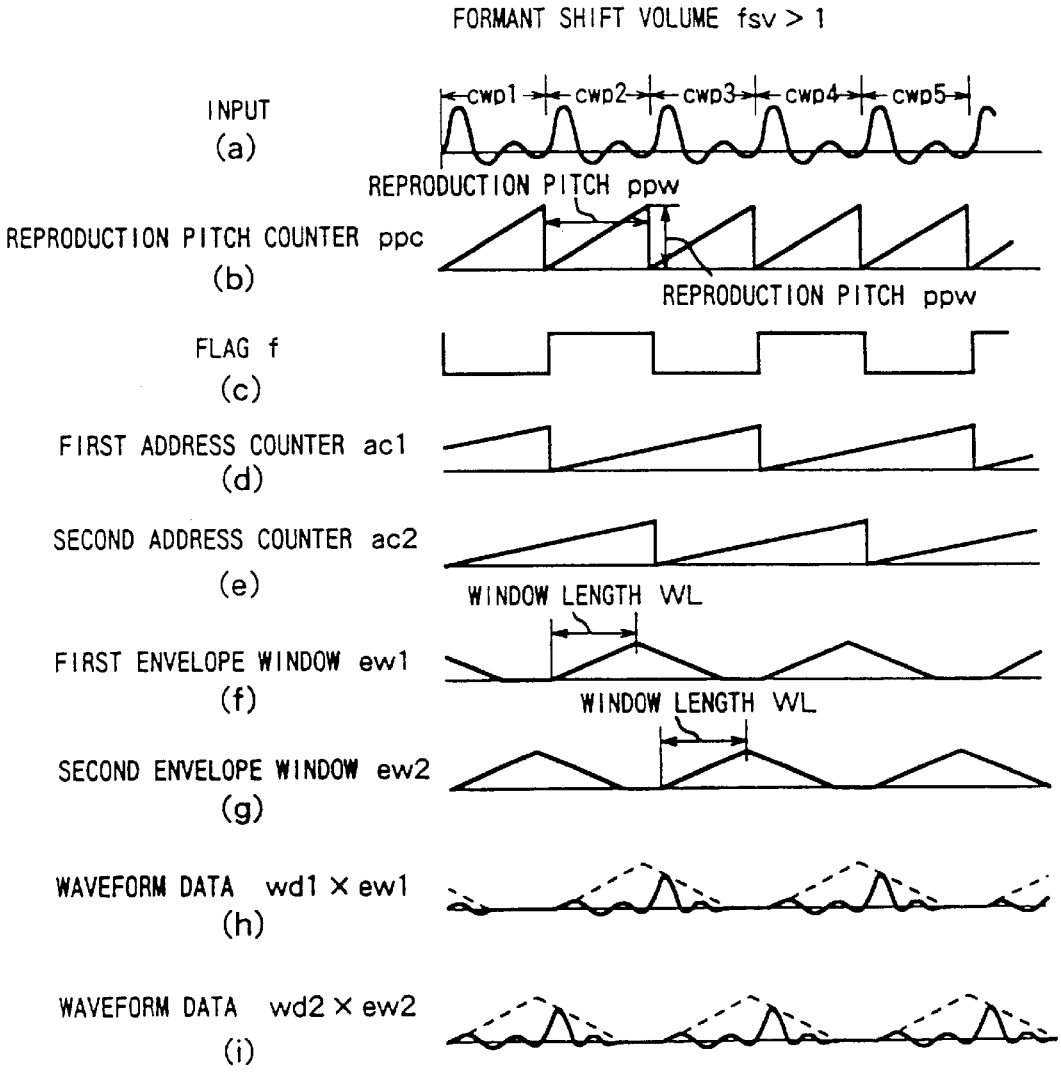
FIG. 24 is a time chart for a brief description of an action of the read process (with formant properties shifted to a lower region).

FIGS. 23 and 24 show each a view for describing the pitch conversion process. In the pitch conversion process, no formant is changed when the formant shift volume fsv is "1", while the formant is changed to some extent when the formant shift volume fsv is a value other than "1". FIG. 23 describes the case where the formant shift volume fsv is "1", that is, no formant is changed, and the reproduction pitch ppw is made higher than the original waveform data of the waveform memory 7. FIG. 24 describes the case where the formant shift volume fsv is greater than "1", that is, the formant is changed, and the reproduction pitch ppw is made equal to the original waveform sequence of the waveform memory 7.

First, with reference to FIG. 23, a description will be made of the case where the pitch is shifted to the higher region side than the original waveform sequence and no formant properties are changed (formant shift volume fsv=1), by specifying the pitch by depressing the key of the keyboard 31.

FIG. 23(*a*) indicates a waveform sequence of a bank 0 region, which indicates cut waveforms corresponding to five cycles starting with the cut start address csa1. The cut waveforms of this waveform sequence has a cut waveform pitch cwp1, cwp2, cwp3, cwp4 and cwp5, respectively.

The reproduction pitch pww is set on the basis of the pitch ratio pr (=the note pitch np/original pitch op) defined in accordance with the note number with the pitch specified by the key of the keyboard 31, as follows:

Reproduction pitch ppw=Cut waveform pitch cwp×pitch ratio pr.

The cycle of the reproduction pitch pww is formed by counting with the reproduction pitch counter ppc. Further, a first address counter ac1 and a second address counter ac2 each for specifying a read address of the waveform data for reproducing the waveform by the two processing systems are formed in synchronization with the reproduction pitch ppw. The first and second address counters ac1 and ac2 are each so arranged as to be incremented one by one in each sampling cycle.

The first processing system reads the cut waveform at a reading velocity determined by the latter half portion, defined by "first address counter ac1×formant shift volume fsv", of the operation of the first waveform read address wra1, as represented by the formula:

First waveform read address *wra*1=First cut start address *fcsa*+first address counter *ac*1×formant shift volume *fsv*, to be executed in step N6 of the waveform read process subroutine, as will be described hereinafter.

Likewise, the second processing system reads the cut waveform at a reading velocity determined by the latter half portion, defined by "second address counter ac2×formant shift volume fsv", of the operation of the second waveform read address wra1, as represented by the formula:

Second waveform read address *wra*2=Second cut start address *scsa*+second address counter *ac*2×formant shift volume *fsv*, to be executed in step N15 of the waveform read process subroutine, as will be described hereinafter.

As described hereinabove, the waveform reading velocity becomes faster or slower than the reference values (=the stepping velocities of the first/second address counters ac1/ac2) on the basis of whether the formant shift volume fsv is greater than or smaller than "1". When the waveform reading velocity is equal to the reference value, the cut waveforms are read in order of address in accordance with the stepping velocities of the first/second address counters ac1/ac2, and the read waveforms are stored as they is with the original formant of the cut waveform retained therein. On the other hand, if the waveform reading velocity becomes greater than the reference value, then the cut waveforms are read at a velocity faster than the reference value, whereby the original formant of the cut waveform is shifted in the read waveform to the higher region side. On the other hand, if the waveform reading velocity becomes smaller than the reference value, the cut waveforms are read at a velocity slower than the reference value, whereby the original formant of the cut waveform is shifted in the read waveform to the lower region side.

In the case of FIG. 23, as the formant shift volume fsv is "1", the first address counter ac1 is varied in a manner and to an extent equal to the second address counter ac2, thereby resulting in no changes in the formant properties.

Furthermore, the first/second processing systems are provided with the envelope windows ew1 and ew2 as windows for cutting the waveform data for processing the formant, in synchronization with the first/second address counters ac1 and ac2, respectively. The first processing system has a waveform of the envelope window ew1 as shown in FIG. 23(*f*), and the second processing system has a waveform of the envelope window ew2 as shown in FIG. 23(*g*). The envelope windows ew1 and ew2 have each a wave height value in the range of from "0" to "1". The window length wl is set to be a half cycle with the first half cycle being so arranged as to increase successively from "0" to "1" and the second half cycle being so arranged as to decrease successively from "1" to "0", thereby forming a triangle shape. The window length wl of each of the envelope windows ew1 and ew2, corresponding to the half cycle, is obtained by the following formula:

Window length *wl*=Cut waveform pitch *cwp*/Characteristic frequency region shift volume *fsv*, in step L12 of the read process routine in a manner as will be described hereinafter. The window length wl is to be restricted to amount to the reproduction pitch ppw at the largest in order not to exceed the reproduction pitch ppw, as will be described hereinafter. FIG. 23 shows the case in which the window length wl is restricted in such a manner.

In the first processing system, the waveform as shown in FIG. 23(*h*) can be obtained by multiplying the cut waveform by the envelope window ew1, the cut waveform being of one or about two pitches cut from the first cut start address fcsa set in step L17 of the read process subroutine as will be described hereinafter. Likewise, in the second processing system, the waveform as shown in FIG. 23(*i*) can be obtained by multiplying the cut waveform by the envelope window ew2, the cut waveform being of one or about two pitches cut from the second cut start address scsa set in step L18 of the read process subroutine as will be described hereinafter.

By processing the cut waveforms in the manner as described hereinabove, they can retain their formant properties of the original waveforms as they are. The waveforms as shown in FIGS. 23(*h*) and 23(*i*) have each a 2-fold length of the cycle length of the reproduction pitch ppw. The both waveforms become as long in length as the cycle length of the reproduction pitch ppw, however, when they are added to each other. Therefore, the formant properties can be retained as they are while shifting the pitch of the original sampling data toward the higher region side by the pitch specified by the key of the keyboard 31.

The playing velocity of the waveform reproduction can be adjusted by varying the velocity at which the cut waveforms are cut one after another in a cut waveform unit from the waveform sequence in a manner as will be described hereinafter. In this case, as the cut waveform nearby an address indicated by the playing position pp is taken, the playing velocity can be increased or decreased by varying the stepping velocities of the playing position pp.

FIG. 24 shows the instance where the formant of the reproducing waveform is shifted to the higher region side than that of the original waveform by making the formant shift volume fsv greater than "1". In this instance, it is shown for ready understanding that the pitch specified by a key is substantially equal to the cut waveform pitch cwp.

The cut waveform reading velocities may be defined by 'first address counter ac1×formant shift volume fsv' for the first processing system and by 'second address counter ac2×formant shift volume fsv' for the second processing system. Therefore, The cut waveform reading velocities of the first and second processing systems become faster than the changes of the first address counter ac1 and the second address counter ac2 and as a consequence the formant properties are shifted to the higher region side, thereby providing the changes for the cut waveforms.

Further, the cut waveform becomes shorter by making the cut waveform reading velocity faster. Accordingly, the window length wl of the envelope windows ew1 and ew2 is made shorter so as to come in compliance with the shortening of the cut waveform as follows:

Window length *wl*=Cut waveform pitch *cwp*/characteristic frequency region shift volume *fsv*.

A description will now be made of actions of the read process as briefly described hereinabove, with reference to FIGS. 25 to 30.

Figure 25:
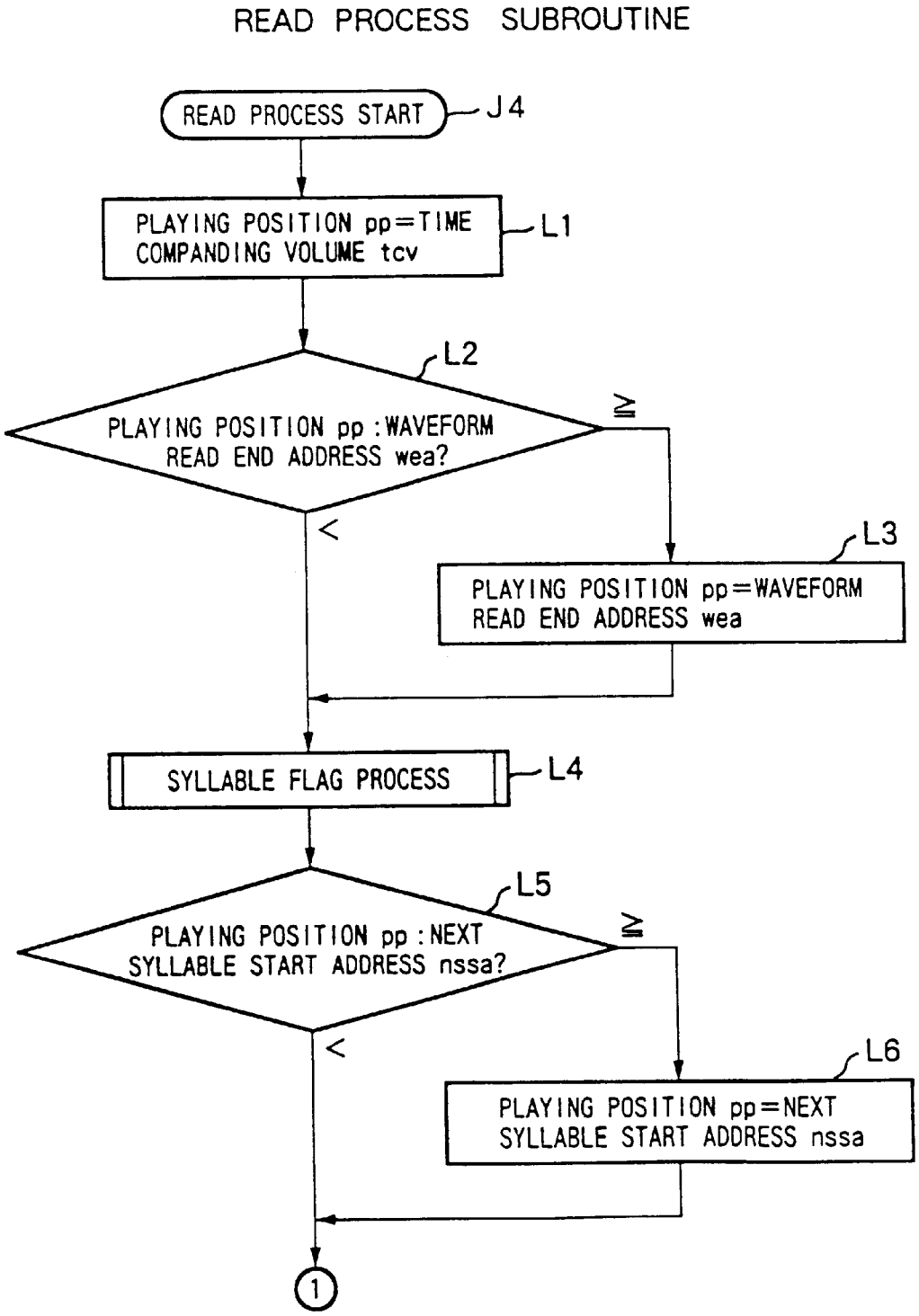
FIG. 25 is a flowchart showing a read process routine (1/3) in the main routine in the DSP in the waveform generation device according to the embodiment of the present invention.
Figure 26:
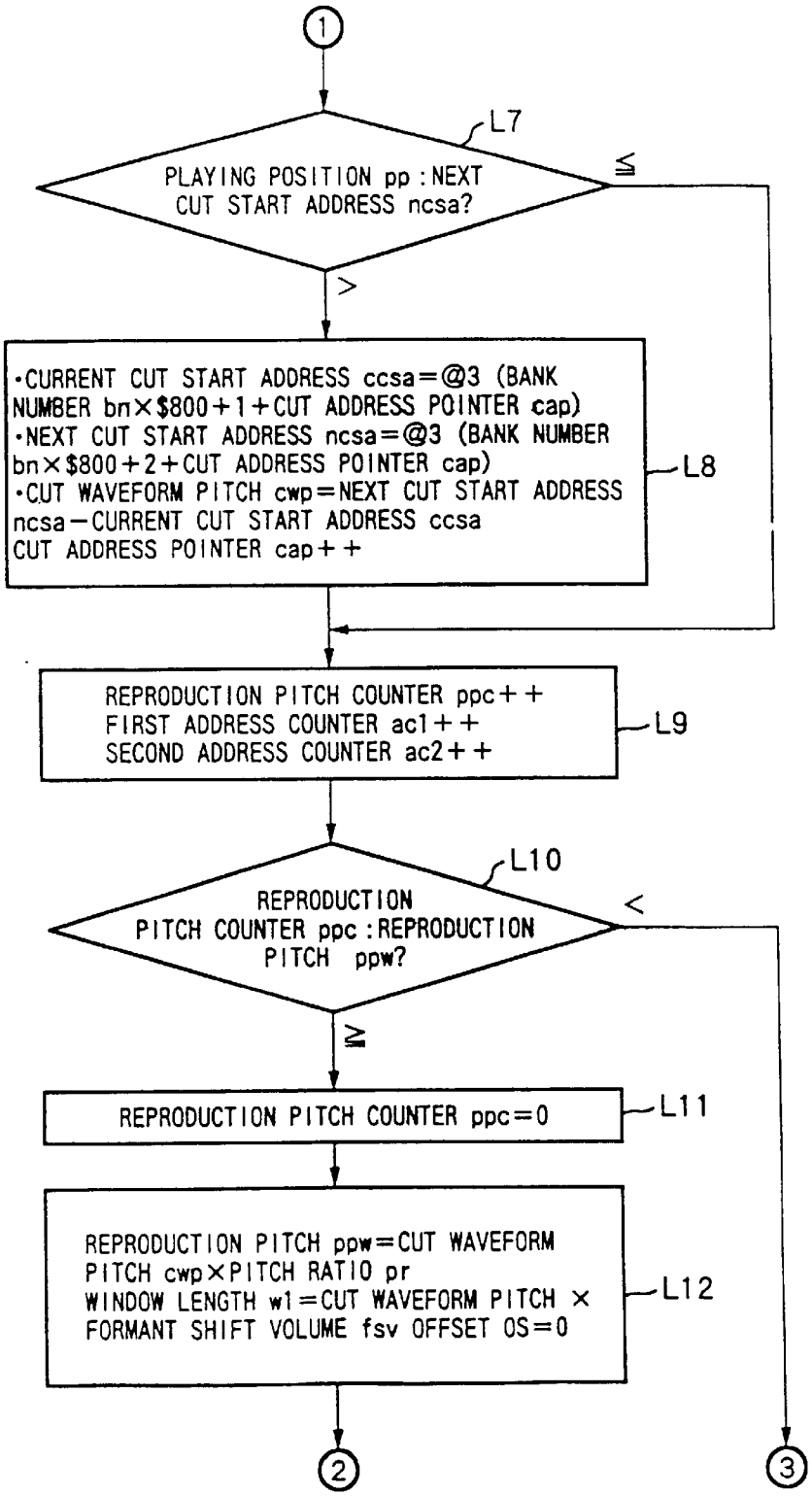
FIG. 26 is a flowchart showing a read process routine (2/3) in the main routine in the DSP in the waveform generation device according to the embodiment of the present invention.
Figure 27:
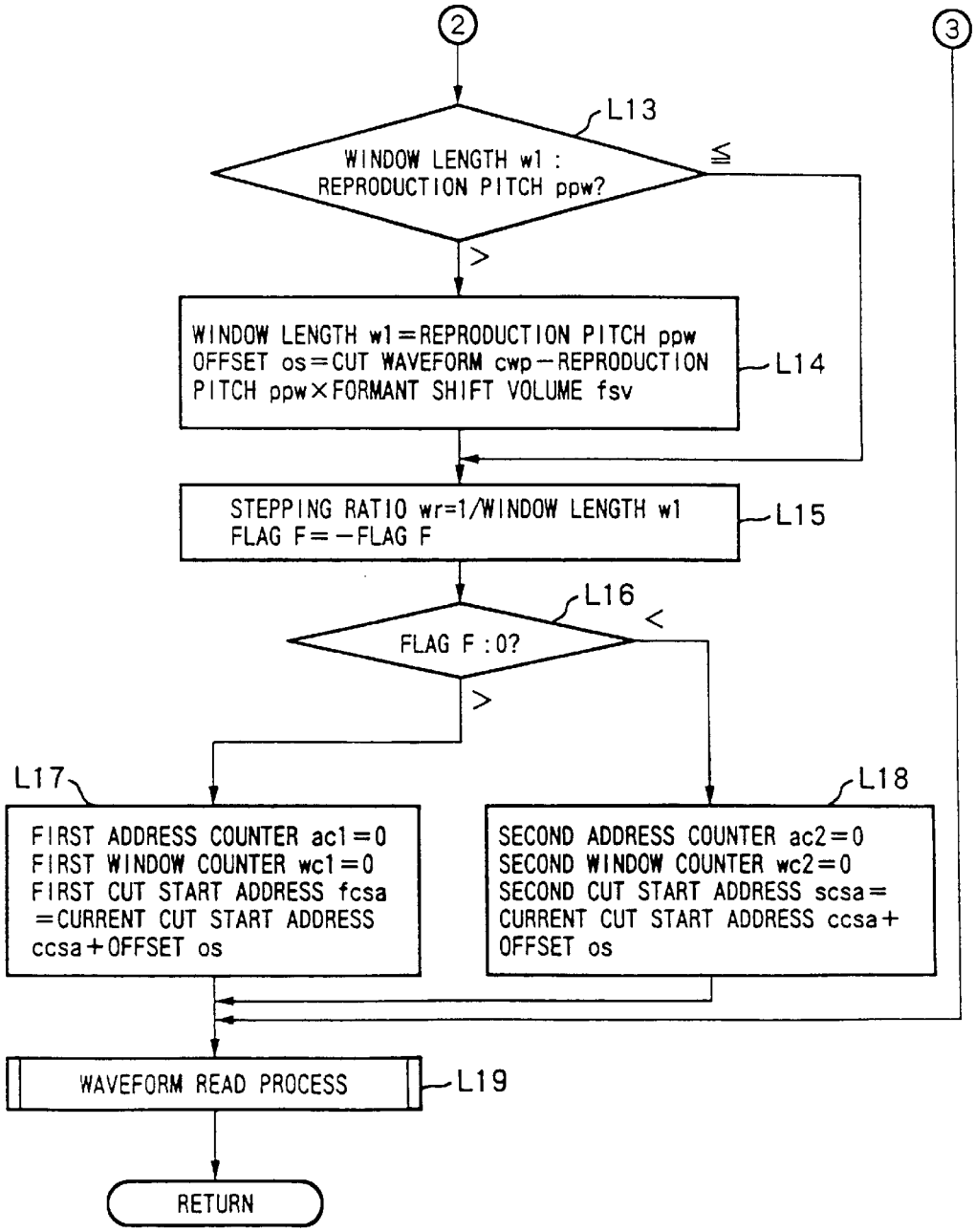
FIG. 27 is a flowchart showing a read process routine (3/3) in the main routine in the DSP in the waveform generation device according to the embodiment of the present invention.

First, an entire action will be described following flowcharts as shown in FIGS. 25–27. The flowcharts correspond to the actions of FIGS. 23 and 24. Each of the registers as described hereinabove has its parameter value initialized upon turning power on. More specifically, the registers are set to their initial values as follows:

Pitch ratio pr=formant shift volume fsv=time companding volume tcv=1.0;

Output level ol=cut address pointer cap=bank number bn=0;

Output envelope level oel=0;

Waveform read end address wea=playing position pp=next cut start address ncsa=first/second cut start address fcsa/scsa=0;

Cut waveform pitch cwp=reproduction pitch ppw=0;

Reproduction counter ppc=gate value g=first address counter ac1=0;

Second address counter ac2=Reproduction pitch ppw/2;

First window counter wc1=0.0

Second window counter wc2=1.0

Identification flag f=1; and

Syllable mark pointer smp=0.

It is to be noted herein that the following description is made on conditions under which each of the registers and counters has already been stored with the appropriate value as defined hereinabove by the processes according to the above flowcharts when some time had elapsed after turning power on. Further, this flowchart is executed in every sampling cycle in the DSP 6.

At the time of generating a voice, the playing position pp is subjected to the voice generation start process as described hereinabove and provided with the cut start address csal of the cut waveform at the top of the waveform sequence indicated by the bank number bn of a processing object in the parameter 3 storage unit of the waveform memory 7. The playing position pp is so arranged as to manage the development of the time of the reproduction of the waveform by setting this address as a reference point. The value of the playing position pp is increased in every sampling cycle with an increment of the time companding volume tcv only (step L1). In other words, the playing position pp is defined as follows:

Playing position *pp*=playing position *pp*+time companding volume *tcv*.

By renewing the playing position pp in the manner as described hereinabove, it is found that, as the time companding volume tcv becomes greater, on the one hand, the playing position pp advances faster making the time required for reproducing an entire waveform sequence shorter and that, as the time companding volume tcv becomes smaller, on the other hand, the playing position pp advances slower making the time required for reproducing the entire waveform sequence longer.

Then, the playing position pp is compared with the cut waveform read end address wea. As a result, when it is found that the playing position pp is located in the position equal to or greater than the waveform read end address wea, it is decided that the process for the waveform sequence of the involved bank number has been finished so that the playing position pp is fixed to the value of the waveform read end address wea (step L3) so as to cause no proceeding with further processes.

Figure 28:
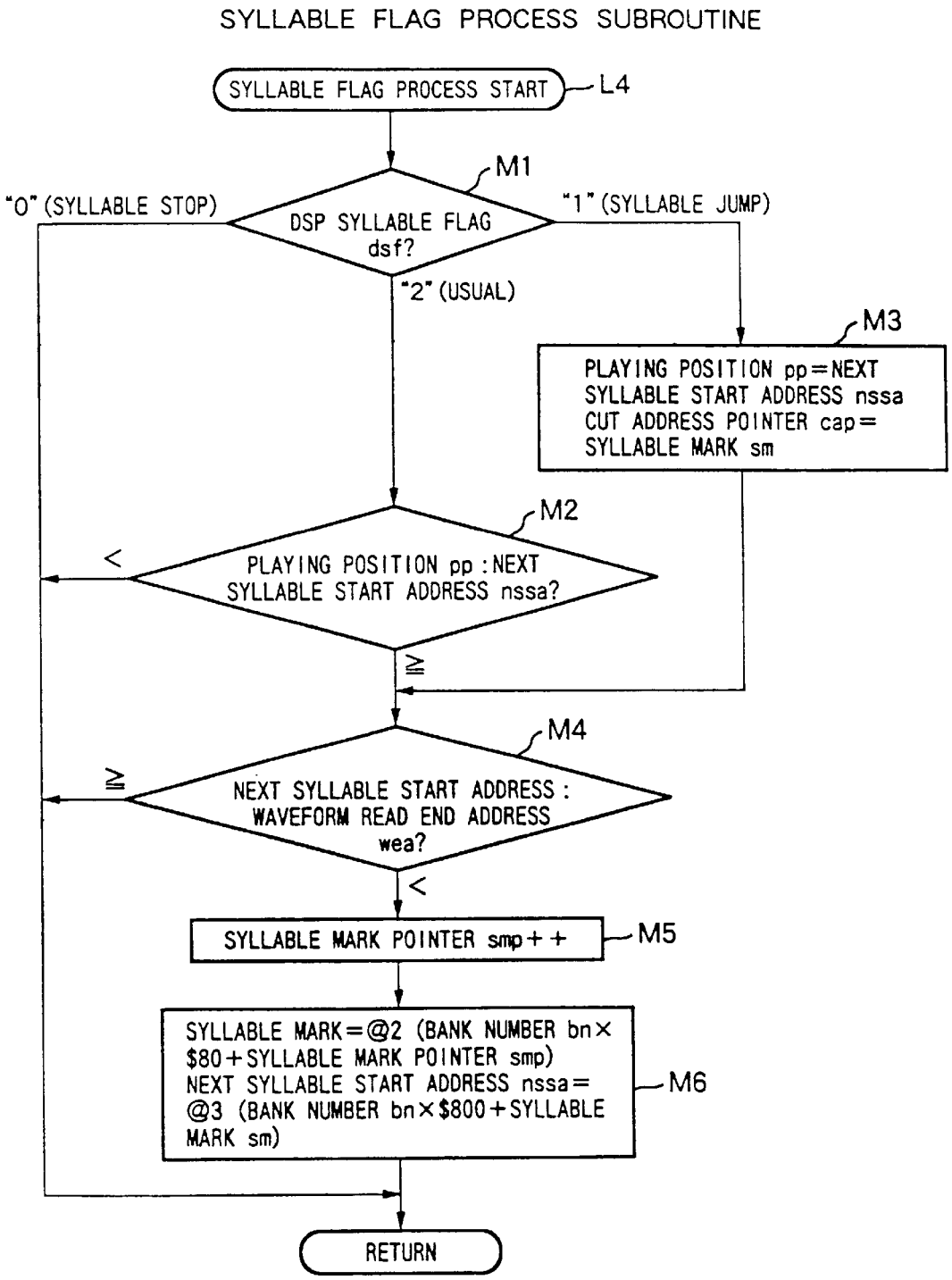
FIG. 28 is a flowchart showing a syllable flag process routine in the read process routine of the DSP main routine in the waveform generation device according to the embodiment of the present invention.

Then, the syllable flag process is carried out (step L4). The syllable flag process is to execute processes, for example, to set values of the various registers and to renew points so as to execute the waveform playing process of a mode in accordance with the value of the DSP syllable flag dsf. FIG. 28 is a flowchart showing a detail of the contents of the syllable flag process.

Then, the syllable flag process will be described with reference to FIG. 28.

In the syllable flag process, first, the value of the DSP syllable flag dsf is decided (step M1). When it is decided that the DSP syllable flag dsf is set to "0" indicating the syllable stop process, this syllable flag process is returned and advances to step L5 of FIG. 25.

When the decision is made that the DSP syllable flag dsf is set to "2" indicating the usual waveform reproduction, the playing position pp is compared with the next syllable start address nssa (step M2). When it is found from the comparison that the playing position pp has not yet reached the next syllable start address nssa, it means that the reproduction of the current syllable is still in process so that this syllable flag process is returned and proceed to step L5 of FIG. 25. When the playing position pp is found that it has reached the next syllable start address nssa, then a preparation is made in steps M5 and M6 for the waveform reproduction of the syllable to come next.

Moreover, when it is found that the DSP syllable flag dsf is set to "1" indicating the syllable jump process, the parameters of the playing position pp and the cut address pointer cap are set as follows:

Playing position pp=next syllable start address nssa;

Cut address pointer cap=Syllable mark sm, in order to allow the start of the reproduction from the top of the syllable that come next by jumping the syllable in current process of reproduction. This process sets the next syllable start address nssa for the start address for the next syllable in the playing position pp and further renews the cut address pointer cap for reading the cut start address from the parameter 3 storage unit to the syllable mark sm.

In steps M4 to M6, a preparation is executed for the waveform reproduction of the syllable.

In this process, the next syllable start address nssa is compared with the waveform read end address wea (step M4). When it is found from this comparison that the next syllable start address nssa has reached the waveform read end address wea, on the one hand, this process is returned and proceeds to step L5 of FIG. 5 because the reproduction of the waveform sequence of the involved waveform number has already been finished. When the next syllable start address nssa has not yet reached the waveform read end address wea, on the other hand, the syllable mark pointer smp is incremented (step M5) so as to read the next syllable mark from the parameter 2 storage unit (syllable mark region) and a syllable mark sm is read from the parameter 2 storage unit with the incremented syllable mark pointer smp in step M6 as follows:

Syllable mark *sm*=@ 2(bank number *bn*×$80+syllable mark pointer *smp*).

Thereafter, using the syllable mark sm read, the cut start address of the cut waveform at the top of the next syllable is read from the parameter 3 storage unit (cut start address region) and it is set as the next syllable start address nssa (step M6).

As the syllable mark process as described hereinabove has been finished, the playing position pp is compared with the next syllable start address nssa (step L5). When the playing position pp is found to be located in the position equal to or greater than the next syllable start address nssa, the playing position pp is set at the next syllable start address nssa (in step L6) as follows:

Playing position pp=Next syllable start address nssa.

In other words, the playing position pp is fixed to the next syllable start address nssa (step F37).

In the syllable flag process of step L4, where the DSP syllable flag dsf is set to "1" or "2", the next syllable start address nssa is renewed to that of a next syllable so that the playing position pp is not decided as being located in the position equal to or greater than the next syllable start address nssa. Therefore, when the DSP syllable flag dsf is "1" or "2", the development of the waveform reproduction does not stop.

Therefore, in instances where the DSP syllable flag dsf is set to "1" indicating the syllable jump process, the current playing position pp is jumped to a next syllable start position nssa for the syllable to come next in step M3, followed by executing the waveform reproduction in a usual manner and executing the syllable jump process as described hereinabove.

On the other hand, in instances where the DSP syllable flag dsf is set to "0" indicating the syllable stop process, the next syllable start address nssa is not renewed in the syllable flag process (step L4). Then, the playing position pp is decided in step L5 as being equal to or greater than the next syllable start address nssa, followed by fixing the playing position pp to the next syllable start address nssa in step L6 so as not to proceed further with the waveform reproduction to the position above the playing position pp and reproducing the identical cut waveforms located in the position corresponding to the end of the syllable in a repeated way, thereby executing the syllable stop process as described hereinabove.

When the playing position pp is located in a position smaller than the next syllable start address nssa, it means that the process has not yet been finished up to the end of the waveform of the syllable in current progress of reproduction. In this case, the playing position pp is further compared with the next cut start address ncsa (step L7). The next cut start address ncsa is the cut start address (top address) of the next cut waveform that follows, as is apparent from the voice generation process of FIG. 22. Therefore, if the playing position pp is greater than the next cut start address ncsa, it means that the process of the cut waveform executed so far has been finished, so that the cut waveform is renewed in order to transfer the process from this cut waveform to the next cut waveform.

The cut waveform is renewed in the manner as will be described hereinafter (step L8).

Current cut start address ccsa=@ 3 (bank number bn×$800+1+cut address pointer cap).

Next cut start address ncsa=@ 3 (bank number bn×$800+2+cut address pointer cap).

Cut waveform pitch cwp=next cut start address ncsa−current cut start address ccsa.

Cut address pointer cap increased by an increment of one.

In other words, the current cut start address ccsa is read from the address indicated by 'cut address pointer cap+1' in the cut start address region of the parameter 3 storage unit of the waveform memory 7. The next cut start address ncsa is also read from the address indicated by 'cut address pointer cap+2' in the cut start address region of the parameter 3 storage unit of the waveform memory 7. Further, a difference (a difference of addresses) is obtained by subtracting the next cut start address ncsa from the current cut start address ccsa, and the resulting difference is set as the cut waveform pitch cwp. Thereafter, the cut address pointer cap is incremented by one.

In step L7, when the playing position pp is found to be smaller than the cut start address ncsa of the next cut waveform, the process of step L8 is jumped without renewing the cut waveform because the process of the current cut waveform is currently in progress.

In the processes of steps L1 to L8 as described hereinabove, the playing position pp advances faster when a larger time companding volume tcv is set, resulting in the earlier reproduction of the first/second cut start addresses fcsa/scsa (in steps L17 and L18 below) and as a consequence making the playing position pp shorter. On the other hand, when the time companding volume tcv is set to be smaller, then the playing position pp advances slower to delay the renewal of the first/second cut start addresses fcsa/scsa, thereby making the playing position pp longer.

It is to be noted herein that in cases where the time companding volume tcv is set to a considerably small value, the waveform reproduction advances at a slow velocity while reproducing the same cut waveforms at plural times in a repeated way. This is because that the playing position pp reaches a value greater than the value to be compared as a reference value takes a long time by the decision at step L7 due to the fact that the playing position pp advances slowly and, as a result, because the read process for the same cut waveforms is executed repeated times without renewing the cut waveform. On the other hand, if the time companding volume tcv is set to a considerably great value, then there may be caused to occur the occasion where, in the process of renewing the cut waveform, the reproduction of the cut waveform to be renewed is not executed by jumping the reproducing cut waveform to the cut waveform to come next.

In this case, in cases where the modulation lever 32 is operated, the time companding volume tcv is changed to the time companding modulation volume TCMV in accordance with the operation volume MLV of the modulation lever 32 in step F17 of the playing process as described hereinabove. Thus, the playing position pp may be varied by the operation volume MLV of the modulation lever 32 in the following way.

(1) Where the operation volume MLV of the modulation lever 32 is in the range of from $00 to $40:

As the operation volume MLV of the modulation lever 32 comes closer to $00, the velocity of the movement of the playing position pp becomes slower. At the operation volume MLV of $00, the movement of the playing position pp becomes in an almost suspended state, thereby continuing the repeated reproduction of the identical cut waveforms. When the operation volume MLV is moved to the middle position, i.e. $40, on the other hand, the playing position pp is allowed to move at the velocity of the set time companding volume STCV set by the time companding operation unit 24 and reproduced.

(2) Where the operation volume MLV of the modulation lever 32 is in the range of from $41 to $7F:

As the operation volume MLV of the modulation lever 32 comes closer to $7F, the velocity of the shift of the playing position pp becomes faster. At the operation volume MLV of $7F, the playing position pp is allowed to move at the velocity two times the velocity of the set time companding volume STCV set by the time companding operation unit 24 and reproduced.

By reproducing the waveform sequence while renewing the cut waveforms using the playing position pp as a time reference in the manner as described hereinabove, the time length required for the waveform reproduction (playing time) can be determined by the time companding volume tcv set by operation of the time companding operation unit 24 and the modulation lever 32 by the user, regardless of the pitch of the waveform to be reproduced.

In step L9, the reproduction pitch counter ppc, the first address counter ac1, and the second address counter ac2 are each stepped by one (step L9), followed by comparing the reproduction pitch counter ppc with the reproduction pitch ppw (step L10). This reproduction pitch ppw corresponds to the pitch to be reproduced. If the reproduction pitch counter ppc does not reach the reproduction pitch ppw, the process proceeds to a waveform read process of step L19 as will be described hereinafter. The reproduction pitch ppw may be computed in step L12 in a manner as will be described hereinafter.

In the instance where the reproduction pitch counter ppc reaches the value of the reproduction pitch ppw, then the processes of steps L11 to L18 are executed. The processes in the steps L11 to L18 are to renew the values of the various parameters for executing the processes at a cycle of the pitch that follows next. In these processes, first, the reproduction pitch counter ppc is set to "0" (step L11), followed by obtaining a new reproduction pitch ppw by multiplying the pitch ratio pr (=note pitch np/original pitch op) by the cut waveform pitch cwp, the pitch ratio pr being based on the key with its voce height specified by depressing the key of the keyboard 31 (step L12). Thereafter, the cut waveform pitch cwp is divided with the formant shift volume fsv, thereby yielding the window length wl of the envelope window (step L12), followed by setting the offset os to "0".

The next processes are executed to restrict the window length wl within the reproduction pitch ppw (steps L13 & 14). First, the window length wl is compared with the reproduction pitch ppw (step L13). As a result, when the window length wl is decided to be greater than the reproduction pitch ppw, on the one hand, the window length wl is set to be the reproduction pitch ppw (step L14). Further, the offset os is determined by subtracting the product obtained by multiplying the reproduction pitch ppw by the formant shift volume fsv from the cut waveform pitch cwp. The offset os is a parameter for cutting a cut waveform nearby the center of the envelope window, as will be described hereinafter. On the other hand, when the window length wl is decided to be equal to or smaller than the reproduction pitch ppw, then the process of step L14 is not executed. In other words, the above processes are executed in order to restrict the window length wl so as to fail to become greater than the reproduction pitch ppw.

Then, an inverse number of the window length wl is computed and set as a stepping ratio wr (step L15).

The stepping ratio wr is used to step the first window counter wc1 and the first window counter wc2. Further, the polarity of the identification flag f is reversed. The process of step L14 is executed when the reproduction pitch counter ppc becomes equal to or greater than the reproduction pitch ppw in step L10 and the inversion of the identification flag f is effected when the reproduction pitch counter ppc becomes equal to or greater than the reproduction pitch ppw. For example, as shown in FIGS. 23 and 24(*c*), these processes can produce a waveform that can be inverted between "1" and "−1" in a cycle of the reproduction pitch counter ppc.

Then, the value of the identification flag f is compared with "0", followed by deciding whether the identification flag f is "1" or "−1" (step L16). That the value of the identification flag f is "1" means that the identification flag f rises to "1" from "−1". In this case, the first address counter ac1 and the first window counter wc1 in the first processing system are set each to "0" and the first cut start address fcsa is set to a value obtained by adding the offset os to the current cut start address ccsa (step L17).

On the other hand, the value "−1" of the identification flag f means that the identification flag f falls to "−1" from "1". In this case, the second address counter ac2 and the second window counter wc2 in the second processing system are set each to "0" and the second cut start address scsa is set to a value obtained by adding the offset os to the current cut start address ccsa (step L18).

In this case, as the steps L17 and L18 are executed alternately whenever the decision is made that the reproduction pitch counter ppc exceeds the reproduction pitch ppw, the first address counter ac1 and the second address counter ac2 are each so arranged as to change in a cycle having the length two times the length of the reproduction pitch ppw and in such a manner that their phases are different from each other by the reproduction pitch ppw only, respectively, as shown in FIGS. 23(*d*) and 23(*e*). Further, the first cut start address fcsa is renewed at the rising portion of the first address counter ac1 at the timing having the time difference by the reproduction pitch ppw. Likewise, the second cut start address scsa is renewed at the falling portion of the second address counter ac2 at the timing having the time difference by the reproduction pitch ppw.

Following the processes in the step L17 or L18 or in the process in the step L10, the waveform read process is executed when the reproduction pitch counter ppc is decided as yet reaching the reproduction pitch ppw (step L19).

Figure 29:
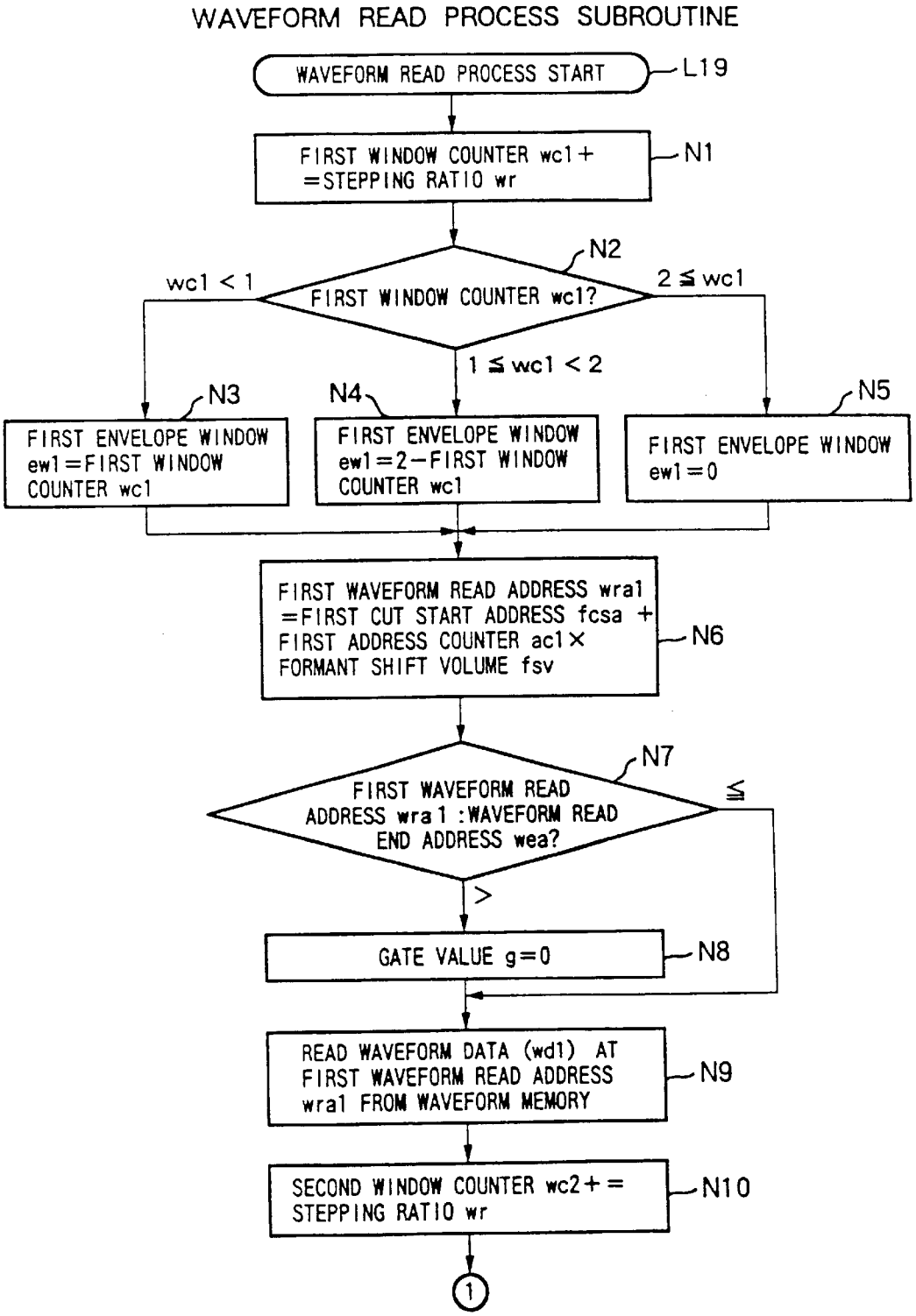
FIG. 29 is a flowchart showing a waveform read process routine (1/2) in the read process routine of the DSP main routine in the waveform generation device according to the embodiment of the present invention.
Figure 30:
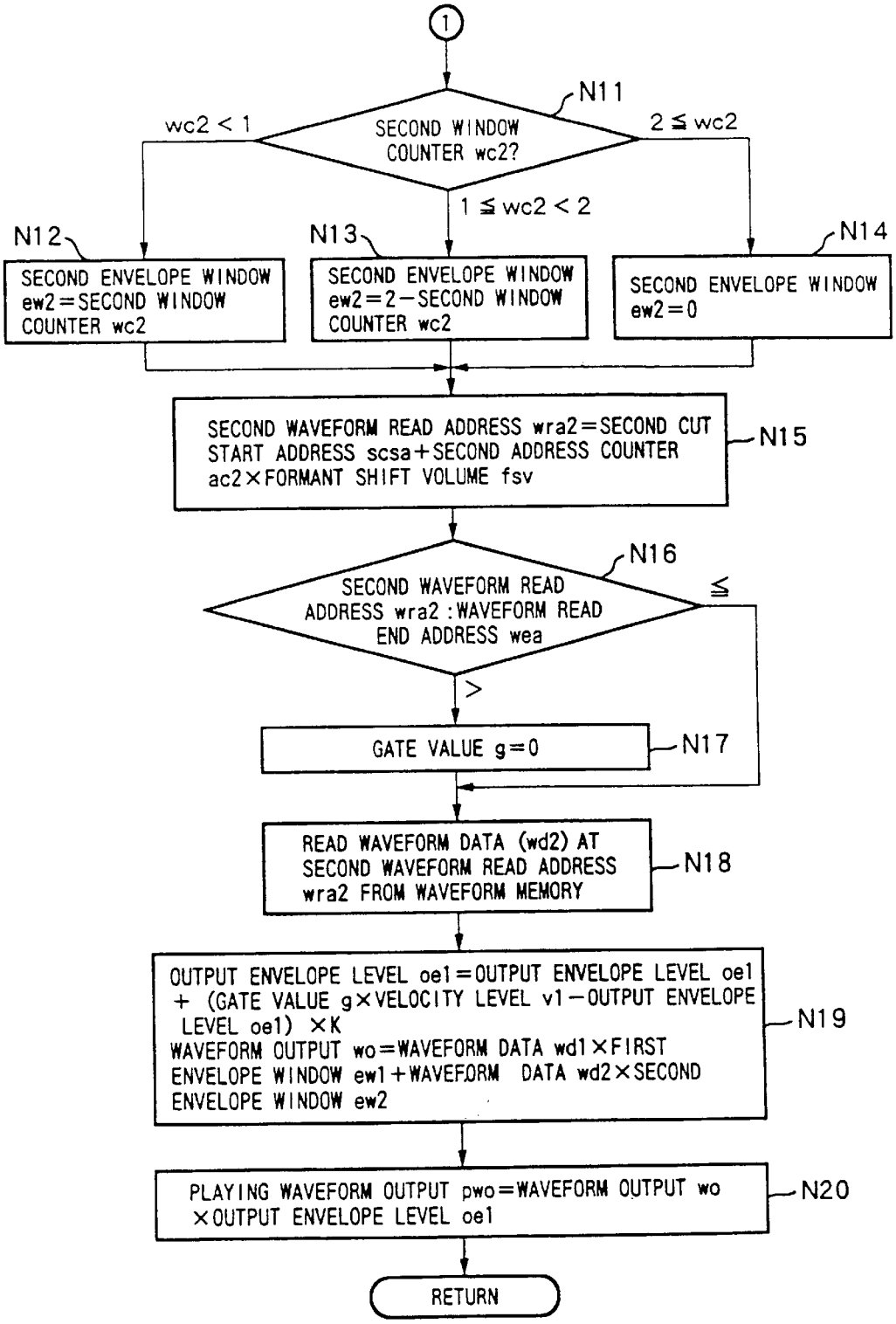
FIG. 30 is a flowchart showing a waveform read process routine (2/2) in the read process routine of the DSP main routine in the waveform generation device according to the embodiment of the present invention.

FIGS. 29 and 30 show flowcharts for the waveform reproduction and a description will then be made of the waveform reproduction more in detail.

Waveform Read Process

In FIGS. 29 and 30, steps N1 to N9 are for processes for the first processing system and steps N10 to N18 are for the second processing system. These two processes are executed in time series and the contents of the processes are substantially equal to each other.

As shown in FIG. 29, first, the waveform read process is executed to cause the value of the first window counter wc1 to step by the stepping ratio wr (step N1), followed by deciding if the stepped first window counter wc1 is smaller than "1" or it is equal to or greater than "1" yet smaller than "2" or it is equal to or greater than "2" (step N2). If it is decided that the first window counter wc1 is smaller than "1", then the value of the first window counter wc1 is set to the first envelope window ew1 (step N3). If the decision is made that it is equal to or greater than "1" yet smaller than "2", then the value of the first window counter wc1 is set to the value obtained by subtracting the first window counter wc1 from "2" as the first envelope window ew1 (step N4). Further, if it is decided to be equal to or greater than "2", then the value of the first window counter wc1 is set to "0" as the first envelope window ew1 (step N5).

The processes executed in the steps N1 to N5 may produce a sawtooth wave that increases the value by the stepping ratio wr, for example, as shown in FIG. 23(*f*), and form the first envelope window ew1 by returning this value at the wave height value "i". If the first window counter wc1 exceeds "2", the wave height value of the first envelope window ew1 is set to "0" in step N5. In other words, this means that the waveform of the first envelope window ew1 is formed as a triangle wave in which the wave height value is increased up to "1" by the stepping ratio wr, which is the inverse number of the window length wl defined on the basis of the formant shift volume fsv and the cut waveform pitch cwp, and then it is decreased to "0".

Following the steps N3 to N5, the value obtained by multiplying the first address counter ac1 (the stepping value of the read address) by the formant shift volume fsv is added to the first cut start address fcsa and the resulting value is set as the read address wra1 of the waveform data (the sampling value) in the first processing system (hereinafter referred to as "first waveform read address") (step N6).

Then, the first waveform read address wra1 is compared with the waveform read end address wea (step N7). When the first waveform read address wra1 is found to be greater than the waveform read end address wea, then the gate value g is set to "0" (step N8). Setting the gate value g to "0" causes the output level to attenuate at a certain inclination and to silence a voice. On the other hand, when the first waveform read address wra1 is found to be equal to or lower than the waveform read end address wea, then the waveform data wd is read from the waveform data storage unit of the waveform memory 7 using the first waveform read address wra1 (step N9). As the first waveform read address wra1 has the stepping width changed by the formant shift volume fsv in the manner as described hereinabove, the reading velocity of reading the cut waveform may consequently be changed by the formant shift volume fsv.

In the processes in steps N10 to N18, substantially the same processes are executed for the second processing.

Thereafter, the output envelope level oel is computed by multiplication by the output o of the read waveform data and the waveform output wo is computed (step I19). The output envelope level oel is computed as follows:

Output envelope level *oel*=Output envelope level *oel*+(gate value *g*×velocity level *vl*−output envelope level *oel*)×*K*.

The output envelope level oel produces an envelope wave which arises gradually at the time of starting the reproduction of the waveform sequence, reaches "1" during the waveform reproduction and falls gradually when the waveform reproduction reaches the waveform read end address wea. In the above formula, reference symbol K is a coefficient for determining the rise/fall inclination.

Moreover, the waveform output wo is determined by the following formula:

Waveform output *wo*=Waveform data *wd*1×first envelope window *ew*1+waveform data *wd*2×second envelope window *ew*2.

This can produce a reproduction waveform by adding the waveform output determined by using the first envelope window ew1 in the first processing system to the waveform output determined by the second envelope window ew2 in the second processing system.

In addition, the final playing waveform output pwo is determined by the following formula:

Playing waveform output *pwo*=Waveform output *wo*×output envelope level *oel*.

Therefore, the output level of the waveform sequence reproduced is so formed as to arise at the inclination following the coefficient K at the time of starting the reproduction of the waveform sequence and to fall at the inclination following the coefficient K as the waveform reproduction has reached the waveform read end address wea, thereby silencing the voice.

In the embodiments as described hereinabove, the present invention is described by taking the features of the present invention as an example where the after-touch function of the keyboard is used for providing instructions for the various processes including the syllable stop process, the syllable jump process and so on. It is to be understood as a matter of course, however, that the present invention should not be construed as being restricted in any respects to those embodiments as described hereinabove and that the present invention encompasses any other embodiments in which those processes be executed using other operation units other than the keyboard. For example, a lever may also be used which is so disposed as to swing forward and rearward from its neutral position and to execute the waveform reproduction in a usual way in its neutral position, the syllable stop process in the forward position, and the syllable jump process in the rearward position. Further, a button switch may be used for giving such instructions for those processes as described hereinabove.

Further, in the above embodiments, the present invention is described by taking the features of the present invention as an example where the waveform reproduction is controlled by stopping, resuming and jumping the pitch in a syllable unit. It is to be understood as a matter of course, however, that the present invention should not be construed as being restricted in any respects to those embodiments as described hereinabove and that the present invention encompasses any other embodiments in which the waveform reproduction may be so arranged as to proceed in each segment position that can present a performance or the like in a more pleasant fashion, for example, by segmenting the waveform sequence into each word or each measure of a music.

Furthermore, in the embodiments as described hereinabove, although the present invention is described by taking the features of the present invention as an example where a word having a syllable is supposed to be a waveform signal, it is to be understood as a matter of course, that the present invention should not be construed as being restricted in any respects to those embodiments as described hereinabove and that the present invention encompasses any other modifications and variations in which a music by a musical instrument is used.

Moreover, in the above embodiments, as a means for executing the waveform reproduction, there is employed a means for reproducing a waveform at a desired reproduction pitch by managing the development of the waveform reproduction based on information on the playing position. As a matter of course, however, it is to be understood that the present invention should not be construed as being restricted in any respects to those embodiments as described hereinabove and that the present invention encompasses any other modifications and variations of various waveform reproduction means within the scope and the spirit of the present invention.

Effects of the Invention

The present invention presents the advantages and effects that the velocity of reproducing a waveform can be changed without changing a pitch or a pitch and a formant.

The present invention further presents the advantages and effects that the user can control the development of segments of syllables and so on at a real time, for example, by stopping or resuming the reproduction of the waveform in a syllable unit or jumping to the next syllable. This serves as having performance or the like filled with representation.

What is claimed is:

1. A waveform generating device, comprising:

a storage means for storing waveform data of a waveform sequence with plural waveforms arranged in time series;

a pitch information input means for entering pitch information concerning a pitch;

a time information generation means for generating time information concerning a time varying with a changing velocity having no connection with a reproduction pitch; and a reproduction means including a read means for reading waveform data in correspondence with the pitch information and the time information, said read means being for reading the waveform data from the storage means at a reading velocity having no connection with a changing velocity of changing the time information, and said reproduction means being for reproducing the read waveform data at a reproduction pitch corresponding to the pitch information of said pitch information input means.

2. The waveform generation device as claimed in claim 1, further comprising a first control information input means for entering first control information for changing the changing velocity of said time information;

wherein said time information generation means has a means for changing the changing velocity of the time information in accordance with said first control information to be entered.

3. The waveform generation device as claimed in claim 2, wherein said time information generation means comprises a counter so arranged as to change a stepping volume in accordance with said first control information to be entered.

4. The waveform generation device as claimed in any one of claims 1 to 3, wherein:

said read means is configured to read a waveform segment containing a waveform of at least one cycle of a position indicated by said time information in a cycle corresponding to said pitch information and at a reading velocity having no connection with the changing velocity of said time information and to convert said waveform data into said reproduction pitch with a formant held therein.

5. The waveform generation device as claimed in claim 4, wherein:

said read means has two processing systems; and each processing system is configured to generate a waveform of at least one cycle of said waveform data at a cycle corresponding a two-fold length of said reproduction pitch and to convert said waveform data of the waveform segment into said reproduction pitch by eventually adding output from said two processing systems to each other.

6. The waveform generation device as claimed in claim 4, further comprising a formant change information input means for entering change information for changing a formant of a waveform of the waveform sequence;

wherein said read means is configured to perform a control to make the reading velocity for reading the waveform data of the waveform segment slower when said change information is information to shift the formant thereof to a low region side and to perform a control to make the reading velocity of the waveform data thereof faster when said change information is information to shift the formant thereof to a high region side.

7. A waveform generation device comprising:

a storage means for storing waveform data of a waveform sequence with plural waveforms arranged in time series;

a reproducing velocity information input means for entering reproducing velocity information representing a reproducing velocity of the waveform data;

a pitch information input means for entering pitch information concerning a pitch; and a reproduction means for reproducing a waveform data of the storage means at a reproducing velocity corresponding to said reproducing velocity information and at a pitch corresponding to said pitch information;

wherein:

said storage means stores the waveform data and mark information indicating one or more positions of the waveform sequence on a time axis; and said reproduction means has a first control means for performing a control for controlling a movement of a reproduction position of the waveform data when the reproduction position of the waveform data has reached a position indicating the mark information.

8. The waveform generation device as claimed in claim 7, wherein:

said reproduction means comprises a time information generation means for generating time information representing the reproduction position of the waveform data and changing at a changing velocity corresponding to said reproducing velocity information; and a read means for reading a waveform data of the waveform sequence corresponding to the time information from said storage means; wherein the waveform data to be read is reproduced at a reproduction pitch corresponding to the pitch information of said pitch information means; and said first control means performs the control for controlling the movement of the time information when the time information of said time information generation means has reached a position indicating the mark information.

9. A waveform generation device comprising:

a storage means for storing waveform data of a waveform sequence with plural waveforms arranged in time series;

a reproducing velocity information input means for entering reproducing velocity information representing a reproducing velocity of the waveform data;

a pitch information input means for entering pitch information concerning a pitch; and a reproduction means for reproducing waveform data of said storage means at a reproducing velocity corresponding to said reproducing velocity information and at a pitch corresponding to said pitch information; and wherein:

said storage means stores the waveform data and mark information indicating one or more positions of the waveform sequence on a time axis;

a second control information input means for entering second control information for controlling a movement of a reproduction position is provided; and said reproduction means comprises a second control means for performing a control for controlling a movement of a reproduction position of the waveform data when the reproduction position of the waveform data corresponding to the second control information has reached a position indicating the mark information of the waveform sequence and for releasing a controlled status in which the movement of the reproduction position of the waveform data is controlled, in accordance with said control information.

10. The waveform generation device as claimed in claim 9, wherein:

said reproduction means comprises a time information generation means for generating time information representing a reproduction position of the waveform data and changing at a changing velocity corresponding to said reproducing velocity information; and a read means for reading a waveform data of the waveform sequence corresponding to the time information from said storage means, wherein the waveform data to be read is reproduced at a reproduction pitch corresponding to the pitch information of said pitch information input means; and said second control means performs the control for controlling the movement of the time information when the time information of said time information generation means has reached a position indicating the mark information and for released a controlled status in which the movement thereof is controlled, in accordance with the second control information.

11. A waveform generation device comprising:

a storage means for storing waveform data of a waveform sequence with plural waveforms arranged in time series;

a reproducing velocity information input means for entering reproducing velocity information representing a reproducing velocity of the waveform data;

a pitch information input means for entering pitch information; and a reproduction means for reproducing a waveform data of the storage means at a reproducing velocity corresponding to said reproducing velocity information and at a pitch corresponding to said pitch information;

said storage means stores the waveform data and mark information indicating one or more positions of the waveform sequence on a time axis;

a third control information input means for entering third control information for controlling a movement of a reproduction position is provided; and said reproduction means comprises a third control means for performing a control for jumping a reproduction position of the waveform data to a position indicating the mark information in accordance with said third control information.

12. The waveform generation device as claimed in claim 11, wherein:

said reproduction means comprises a time information generation means for generating time information representing the reproduction position of the waveform and changing the reproduction position at a changing velocity corresponding to said reproducing velocity information; and a read means for reading a waveform data of the waveform sequence corresponding to the time information from the storage means; wherein the waveform data to be read is reproduced at a reproduction pitch corresponding to the pitch information of said pitch information input means; and said third control means performs the control for jumping the time information of said time information generation means to a position indicating the mark information in accordance with the third control information.

13. The waveform generation device as claimed in any one of claims 7 to 12, wherein said reproducing velocity information input means is arranged to enter the reproducing velocity information representing the reproducing velocity of the waveform data at a real time as time elapses.

14. The waveform generation device as claimed in claim 5, further comprising a formant change information input means for entering change information for changing a formant of a waveform of the waveform sequence;

wherein said read means is configured to perform a control to make the reading velocity for reading the waveform data of the waveform segment slower when said change information is information to shift the formant thereof to a low region side and to perform a control to make the reading velocity of the waveform data thereof faster when said change information is information to shift the formant thereof to a high region side.

* * * * *